US011878894B2

(12) United States Patent
Hara et al.

(10) Patent No.: US 11,878,894 B2
(45) Date of Patent: Jan. 23, 2024

(54) SHEET DISCHARGER

(71) Applicant: RISO KAGAKU CORPORATION, Tokyo (JP)

(72) Inventors: Masashi Hara, Ibaraki (JP); Yoshifumi Noguchi, Ibaraki (JP); Yoshiyuki Okada, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 65 days.

(21) Appl. No.: 17/587,312

(22) Filed: Jan. 28, 2022

(65) Prior Publication Data

US 2022/0258995 A1 Aug. 18, 2022

(30) Foreign Application Priority Data

Feb. 12, 2021 (JP) ..... 2021-020948
Sep. 29, 2021 (JP) ..... 2021-159383

(51) Int. Cl.

| | |
|---|---|
| ***B65H 29/62*** | (2006.01) |
| ***B65H 43/04*** | (2006.01) |
| ***G03G 15/00*** | (2006.01) |
| ***B65H 7/06*** | (2006.01) |
| ***B65H 29/58*** | (2006.01) |

(52) U.S. Cl.

CPC ..... *B65H 7/06* (2013.01); *B65H 29/58* (2013.01); *B65H 2511/528* (2013.01); *B65H 2801/21* (2013.01)

(58) Field of Classification Search

CPC ..... B65H 29/62; B65H 29/58; B65H 43/04; B65H 2511/528; B65H 31/24; B65H 7/06; B65H 2601/11; G03G 15/70; G03G 15/5012; G03G 2215/00552; G03G 2215/00548

See application file for complete search history.

(56) References Cited

U.S. PATENT DOCUMENTS 8,272,731 B2 * 9/2012 Watanabe ..... B41J 11/20 347/101
2012/0081727 A1 * 4/2012 Song ..... G03G 15/70 358/1.13

FOREIGN PATENT DOCUMENTS

JP 09124208 A * 5/1997
JP 2001278501 A * 10/2001
JP 2011253011 A * 12/2011
JP 2019-130755 8/2019

* cited by examiner

*Primary Examiner* — Luis A Gonzalez
(74) *Attorney, Agent, or Firm* — GREENBLUM & BERNSTEIN, P.L.C.

(57) ABSTRACT

A sheet discharger includes: an accommodator configured to accommodate sheets; a conveyor configured to convey and discharge a sheet to the accommodator; a detector configured to detect whether a jam of a sheet has occurred in the accommodator and a state of the jam; and a controller configured to control the conveyor to continue sheet discharge upon detection by the detector of the jam in a state where sheet discharge of a jammed sheet is possible.

6 Claims, 13 Drawing Sheets

SHEET DISCHARGER

CROSS REFERENCE TO RELATED APPLICATION

This application is based upon and claims the benefit of priority from the prior Japanese Patent Application Nos. 2021-020948 filed on Feb. 12, 2021 and 2021-159383 filed on Sep. 29, 2021, the entire contents of which are incorporated herein by reference.

BACKGROUND

1. Technical Field

The disclosure relates to a sheet discharger.

2. Related Art

Japanese Patent Application Publication No. 2019-130755 discloses a printing system in which multiple printers are connected in series.

The printing system above is required to perform various functions along with an increase in printing speed. To handle this requirement, the printing system allows connection with optional apparatuses such as an image inspection apparatus and a sheet discharger.

SUMMARY

The printing system including the optional apparatuses above becomes large in size and the sheet conveyance route becomes long. Thus, when a sheet jam occurs and a sheet conveyance operation is stopped, the number of sheets remaining in the conveyance route becomes large and labor for removing the sheets increases accordingly.

Specifically, in the case where a jam has occurred in the most downstream sheet discharger in the conveyance direction of sheets, sheets remain in all of the apparatuses located upstream of the most downstream sheet discharger and thus the number of remaining sheets becomes large and labor for removing the sheets increases accordingly.

The disclosure is directed to a sheet discharger capable of reducing labor for removing sheets remaining in a printing system at the time of the occurrence of a jam.

A sheet discharger in accordance with some embodiments includes: an accommodator configured to accommodate sheets; a conveyor configured to convey and discharge a sheet to the accommodator; a detector configured to detect whether a jam of a sheet has occurred in the accommodator and a state of the jam; and a controller configured to control the conveyor to continue sheet discharge upon detection by the detector of the jam in a state where sheet discharge of a jammed sheet is possible.

According to the aforementioned configuration, it is possible to reduce labor for removing sheets remaining in a printing system at the time of the occurrence of a jam.

DETAILED DESCRIPTION

Figure 1:
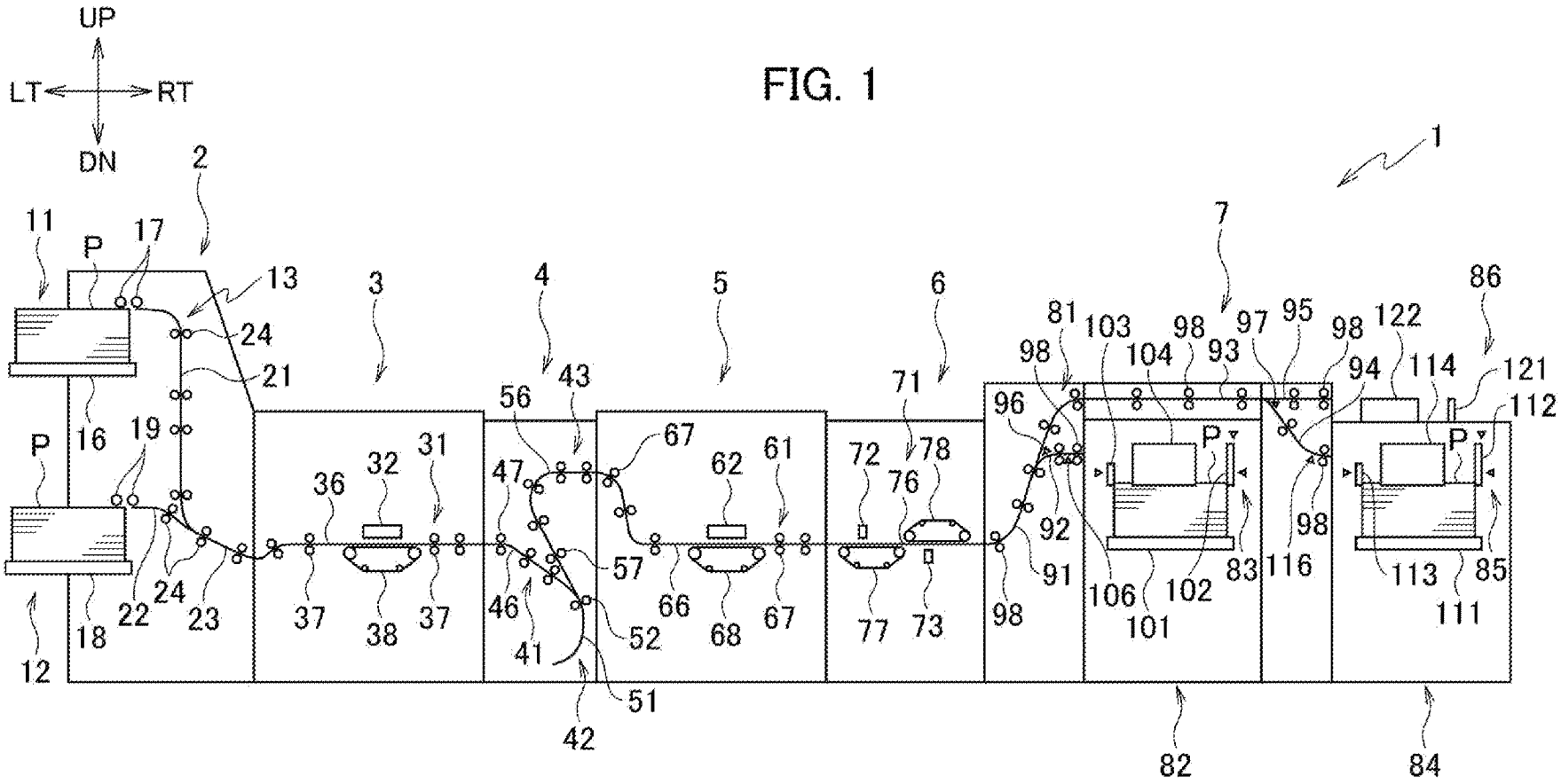
FIG. 1 is a schematic configuration diagram of a printing system according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from that in reality.

Figure 2:
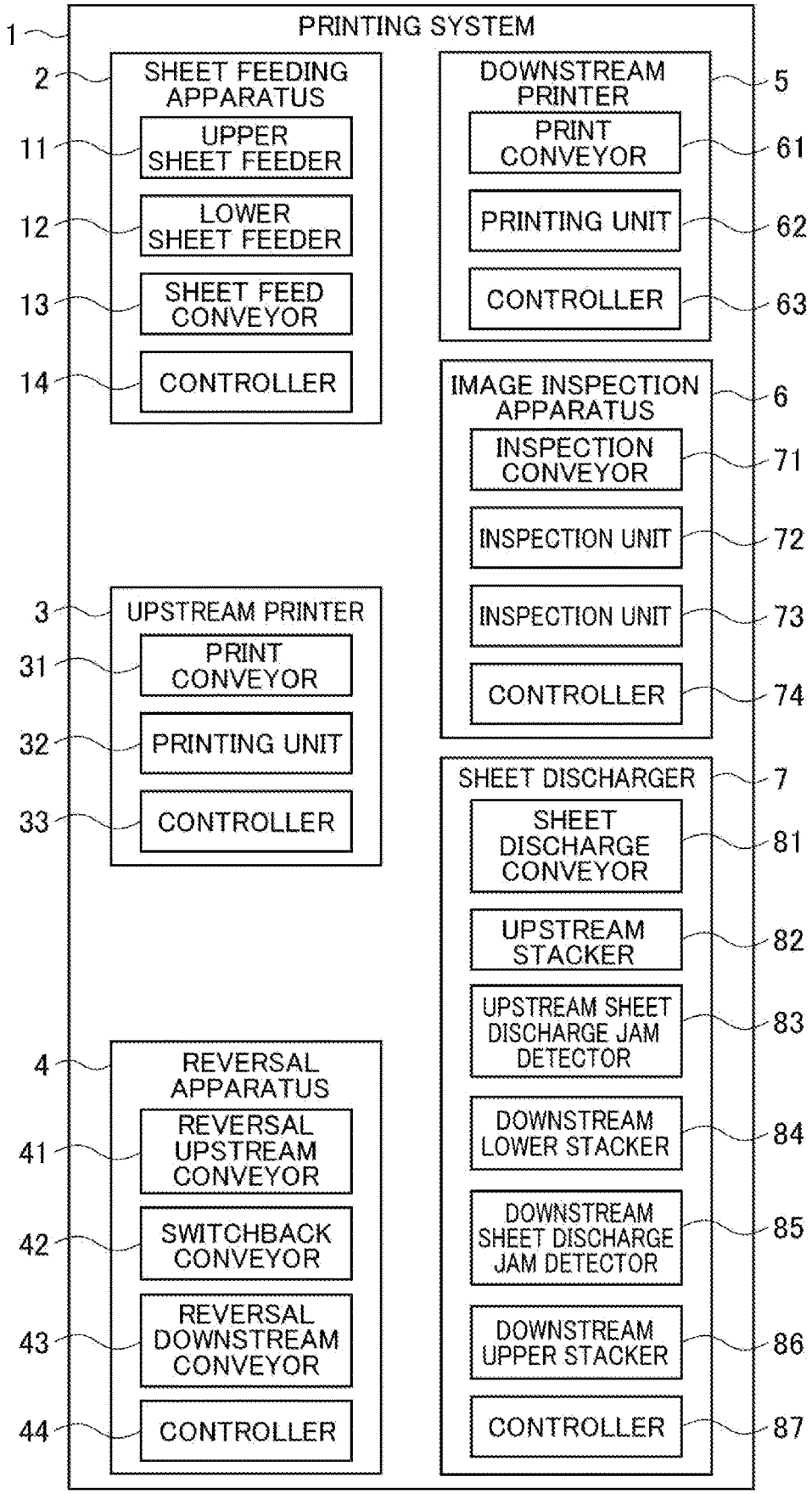
FIG. 2 is a control block diagram of the printing system illustrated in FIG. 1.
Figure 3:
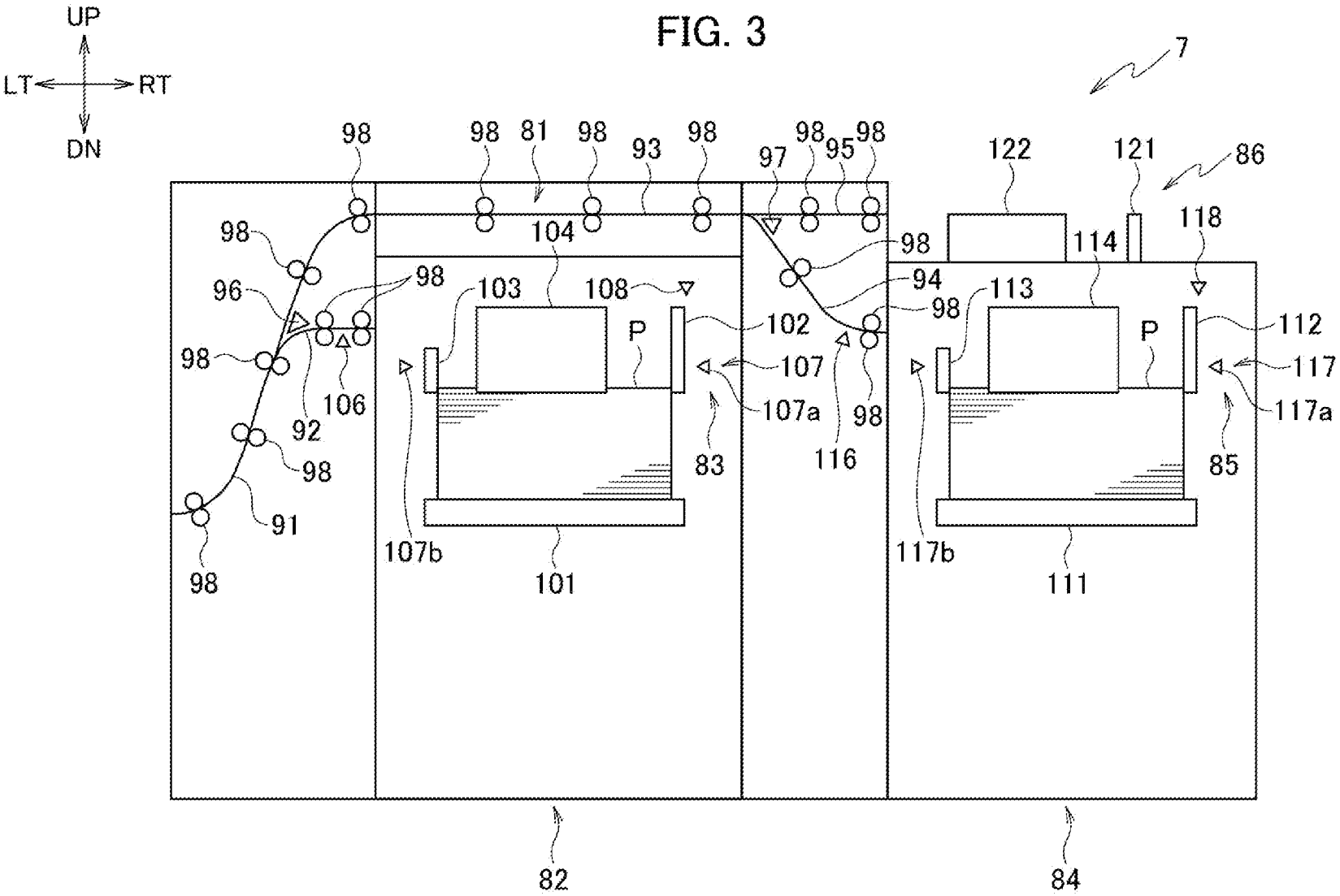
FIG. 3 is a schematic configuration diagram of a sheet discharger of the printing system illustrated in FIG. 1.

FIG. 1 is a schematic configuration diagram of a printing system 1 provided with a sheet discharger 7 according to a first embodiment of the present invention. FIG. 2 is a control block diagram of the printing system 1 illustrated in FIG. 1. FIG. 3 is a schematic configuration diagram of the sheet discharger 7 of the printing system 1 illustrated in FIG. 1. In the following description, right and left in the page space of FIG. 1 is referred to as the right-left direction and up and down is referred to as the up-down direction. In FIGS. 1, 3, 5, 6, and 8 to 13, the directions of right, left, up, and down are denoted by RT, LT, UP, and DN, respectively.

As illustrated in FIGS. 1 and 2, the printing system 1 according to the first embodiment includes a sheet feeding apparatus 2, an upstream printer 3, a reversal apparatus 4, a downstream printer 5, an image inspection apparatus 6, and a sheet discharger 7.

The sheet feeding apparatus 2 feeds a sheet P to the upstream printer 3. The sheet feeding apparatus 2 includes an upper sheet feeder 11, a lower sheet feeder 12, a sheet feed conveyor 13, and a controller 14.

The upper sheet feeder 11 feeds a sheet P to an upper sheet feed route 21 described later. The upper sheet feeder 11 includes an upper sheet feed tray 16 and upper sheet feed rollers 17.

The upper sheet feed tray 16 is a tray on which sheets P to be used in printing are stacked. The upper sheet feed tray 16 is vertically movable (i.e. capable of lifting and lowering).

The upper sheet feed rollers 17 pick up a sheet P from the upper sheet feed tray 16 and feed the sheet P to the upper sheet feed route 21.

The lower sheet feeder 12 feeds a sheet P to a lower sheet feed route 22 described later. The lower sheet feeder 12 includes a lower sheet feed tray 18 and lower sheet feed rollers 19.

The lower sheet feed tray 18 is a tray on which sheets P to be used in printing are stacked. The lower sheet feed tray 18 is arranged below the upper sheet feed tray 16.

The lower sheet feed rollers 19 pick up a sheet P from the lower sheet feed tray 18 and feed the sheet P to the lower sheet feed route 22.

The sheet feed conveyor 13 conveys a sheet P picked up from the upper sheet feed tray 16 and a sheet P picked up from the lower sheet feed tray 18 to the upstream printer 3. The sheet feed conveyor 13 includes the upper sheet feed route 21, the lower sheet feed route 22, a common sheet feed route 23, and conveyance rollers 24.

The upper sheet feed route 21 is a conveyance route for conveying a sheet P from the upper sheet feed tray 16 to the common sheet feed route 23.

The lower sheet feed route 22 is a conveyance route for conveying a sheet P from the lower sheet feed tray 18 to the common sheet feed route 23.

The common sheet feed route 23 is a conveyance route for conveying a sheet P conveyed along the upper sheet feed route 21 and a sheet P conveyed along the lower sheet feed route 22 to the upstream printer 3. The common sheet feed route 23 is connected to a downstream end of the upper sheet feed route 21 and a downstream end of the lower sheet feed route 22 in the conveyance direction of a sheet P.

The conveyance rollers 24 are arranged along the upper sheet feed route 21, the lower sheet feed route 22, and the common sheet feed route 23 and convey a sheet P to the upstream printer 3.

The controller 14 controls operations of the respective components of the sheet feeding apparatus 2. The controller 14 includes a CPU, a memory, and the like. The controller 14 is able to communicate with a controller 33 of the upstream printer 3, a controller 44 of the reversal apparatus 4, a controller 63 of the downstream printer 5, a controller 74 of the image inspection apparatus 6, and a controller 87 of the sheet discharger 7 described later.

The upstream printer 3 conveys a sheet P fed by the sheet feeding apparatus 2, while performing printing on one surface of the sheet P. The upstream printer 3 includes a print conveyor 31, a printing unit 32, and the controller 33.

The print conveyor 31 receives a sheet P from the sheet feeding apparatus 2 and conveys the received sheet P. The print conveyor 31 includes a print conveyance route 36, conveyance rollers 37, and a belt platen 38.

The print conveyance route 36 is a conveyance route along which a sheet P is conveyed below the printing unit 32. An upstream end of the print conveyance route 36 is connected to a downstream end of the common sheet feed route 23.

Some conveyance rollers 37 of the conveyance rollers 37 are arranged along the print conveyance route 36 at an upstream side of the belt platen 38 and convey a sheet P to the belt platen 38. The remaining conveyance rollers 37 are arranged along the print conveyance route 36 at a downstream side of the belt platen 38 and convey a sheet P to the reversal apparatus 4.

The belt platen 38 conveys a sheet P while sucking and holding the sheet P on a belt. The belt platen 38 is arranged below the printing unit 32 to face the printing unit 32.

The printing unit 32 includes inkjet heads (not illustrated) and performs printing by ejecting ink from the inkjet heads onto a sheet P conveyed by the belt platen 38.

The controller 33 controls operations of the respective components of the upstream printer 3. The controller 33 includes a CPU, a memory, and the like. The controller 33 is able to communicate with the controller 14 of the sheet feeding apparatus 2, the controller 44 of the reversal apparatus 4, the controller 63 of the downstream printer 5, the controller 74 of the image inspection apparatus 6, and the controller 87 of the sheet discharger 7 described later.

The reversal apparatus 4 reverses a sheet P conveyed from the upstream printer 3, upside down and conveys the reversed sheet P to the downstream printer 5. The reversal apparatus 4 includes a reversal upstream conveyor 41, a switchback conveyor 42, a reversal downstream conveyor 43, and the controller 44.

The reversal upstream conveyor 41 conveys a sheet P to the switchback conveyor 42. The reversal upstream conveyor 41 includes a reversal upstream route 46 and conveyance rollers 47.

The reversal upstream route 46 is a conveyance route for conveying a sheet P from the upstream printer 3 to the switchback conveyor 42. An upstream end of the reversal upstream route 46 is connected to a downstream end of the print conveyance route 36 of the upstream printer 3. A downstream end of the reversal upstream route 46 is connected to one end (upper end) of a switchback route 51 described later.

The conveyance rollers 47 are arranged along the reversal upstream route 46 and convey a sheet P to the switchback conveyor 42.

The switchback conveyor 42 causes a sheet P conveyed from the reversal upstream conveyor 41 to be fed in reverse (that is, switches back a sheet P) and conveys the reverse-fed sheet P to the reversal downstream conveyor 43. The switchback conveyor 42 includes the switchback route 51 and switchback rollers 52.

The switchback route 51 is a conveyance route for feeding a sheet P in reverse. One end (upper end) of the switchback route 51 is connected to the downstream end of the reversal upstream route 46 and an upstream end of a reversal downstream route 56 described later.

The switchback rollers 52 are rollers for feeding a sheet P in reverse. The switchback rollers 52 are rotatable forward and reverse in order to feed a sheet P in reverse.

The reversal downstream conveyor 43 conveys a sheet P fed in reverse by the switchback conveyor 42 to the downstream printer 5. The reversal downstream conveyor 43 includes the reversal downstream route 56 and conveyance rollers 57.

The reversal downstream route 56 is a conveyance route for conveying a sheet P from the switchback conveyor 42 to the downstream printer 5. The upstream end of the reversal downstream route 56 is connected to one end (upper end) of the switchback route 51.

The conveyance rollers 57 are arranged along the reversal downstream route 56 and convey a sheet P to the downstream printer 5.

The controller 44 controls operations of the respective components of the reversal apparatus 4. The controller 44 includes a CPU, a memory, and the like. The controller 44 is able to communicate with the controller 14 of the sheet feeding apparatus 2, the controller 33 of the upstream printer 3, the controller 63 of the downstream printer 5, the controller 74 of the image inspection apparatus 6, and the controller 87 of the sheet discharger 7 described later.

The downstream printer 5 conveys a sheet P reversed upside down by the reversal apparatus 4, while performing printing on the other surface of the sheet P. The downstream printer 5 includes a print conveyor 61, a printing unit 62, and the controller 63.

The print conveyor 61 receives a sheet P from the reversal apparatus 4 and conveys the received sheet P. The print conveyor 61 includes a print conveyance route 66, conveyance rollers 67, and a belt platen 68.

The print conveyance route 66 is a conveyance route along which a sheet P is conveyed below the printing unit 62. An upstream end of the print conveyance route 66 is connected to a downstream end of the reversal downstream route 56.

Some conveyance rollers 67 of the conveyance rollers 67 are arranged along the print conveyance route 66 at an upstream side of the belt platen 68 and convey a sheet P to the belt platen 68. The remaining conveyance rollers 67 are arranged along the print conveyance route 66 at a downstream side of the belt platen 68 and convey a sheet P to the image inspection apparatus 6.

The belt platen 68 conveys a sheet P while sucking and holding the sheet P on a belt. The belt platen 68 is arranged below the printing unit 62 to face the printing unit 62.

The printing unit 62 includes inkjet heads (not illustrated) and performs printing by ejecting ink from the inkjet heads onto a sheet P conveyed by the belt platen 68.

The controller 63 controls operations of the respective components of the downstream printer 5. The controller 63 includes a CPU, a memory, and the like. The controller 63 is able to communicate with the controller 14 of the sheet feeding apparatus 2, the controller 33 of the upstream printer 3, the controller 44 of the reversal apparatus 4, the controller 74 of the image inspection apparatus 6, and the controller 87 of the sheet discharger 7 described later.

The image inspection apparatus 6 inspects images printed on both surfaces of a sheet P by the upstream printer 3 and the downstream printer 5. The image inspection apparatus 6 includes an inspection conveyor 71, inspection units 72, 73, and the controller 74.

The inspection conveyor 71 receives a sheet P from the downstream printer 5 and conveys the received sheet P. The inspection conveyor 71 includes an inspection conveyance route 76, and belt platens 77, 78.

The inspection conveyance route 76 is a conveyance route for conveying a sheet P such that the sheet P passes through reading regions of the inspection units 72, 73. An upstream end of the inspection conveyance route 76 is connected to a downstream end of the print conveyance route 66.

The belt platen 77 conveys a sheet P conveyed from the downstream printer 5 while sucking and holding the sheet P on a belt. The belt platen 77 is installed such that a conveyance surface of the belt platen 77 on which the sheet P is sucked and held faces upward.

The belt platen 78 receives a sheet P from the belt platen 77 and conveys the received sheet P. The belt platen 78 is installed such that a conveyance surface of the belt platen 78 faces downward and the belt platen 78 conveys the sheet P while sucking and holding the sheet P on the conveyance surface facing downward.

The inspection unit 72 reads the image on the upward surface of a sheet P conveyed by the belt platen 77 for inspection. The inspection unit 73 reads the image on the downward surface of a sheet P conveyed by the belt platen 78 for inspection.

The controller 74 controls operations of the respective components of the image inspection apparatus 6. The controller 74 includes a CPU, a memory, and the like. The controller 74 is able to communicate with the controller 14 of the sheet feeding apparatus 2, the controller 33 of the upstream printer 3, the controller 44 of the reversal apparatus 4, the controller 63 of the downstream printer 5, and the controller 87 of the sheet discharger 7 described later.

The sheet discharger 7 discharges a sheet P printed by the upstream printer 3 and the downstream printer 5. As illustrated in FIGS. 2 and 3, the sheet discharger 7 includes a sheet discharge conveyor (conveyor) 81, an upstream stacker (stacker) 82, an upstream sheet discharge jam detector (detector) 83, a downstream lower stacker (stacker) 84, a downstream sheet discharge jam detector (detector) 85, a downstream upper stacker (stacker) 86, and the controller 87. The upstream stacker 82, downstream lower stacker 84, and the downstream upper stacker 86 form an accommodator which accommodates sheets P.

The sheet discharge conveyor 81 receives a sheet P conveyed from the sheet feeding apparatus 2 via the upstream printer 3, the reversal apparatus 4, the downstream printer 5, and the image inspection apparatus 6, conveys the received sheet P, and discharges the sheet P selectively to the upstream stacker 82, the downstream lower stacker 84, or the downstream upper stacker 86. The sheet discharge conveyor 81 includes a common sheet discharge route 91, an upstream sheet discharge route 92, a downstream common sheet discharge route 93, a downstream lower sheet discharge route 94, a downstream upper sheet discharge route 95, switchers 96, 97, and conveyance rollers 98.

The common sheet discharge route 91 is a common conveyance route for sheets P conveyed to the upstream stacker 82, the downstream lower stacker 84, or the downstream upper stacker 86 in the sheet discharge conveyor 81.

An upstream end of the common sheet discharge route 91 is connected to a downstream end of the inspection conveyance route 76.

The upstream sheet discharge route 92 is a conveyance route for conveying and discharging a sheet P to the upstream stacker 82. An upstream end of the upstream sheet discharge route 92 is connected to a downstream end of the common sheet discharge route 91.

The downstream common sheet discharge route 93 is a common conveyance route for sheets P conveyed to the downstream lower stacker 84 or the downstream upper stacker 86. An upstream end of the downstream common sheet discharge route 93 is connected to the downstream end of the common sheet discharge route 91.

The downstream lower sheet discharge route 94 is a conveyance route for conveying and discharging a sheet P to the downstream lower stacker 84. An upstream end of the downstream lower sheet discharge route 94 is connected to a downstream end of the downstream common sheet discharge route 93.

The downstream upper sheet discharge route 95 is a conveyance route for conveying and discharging a sheet P to the downstream upper stacker 86. An upstream end of the downstream upper sheet discharge route 95 is connected to the downstream end of the downstream common sheet discharge route 93.

The switcher 96 switches the conveyance destination of a sheet P conveyed downstream from the common sheet discharge route 91, between the upstream sheet discharge route 92 and the downstream common sheet discharge route 93. The switcher 97 switches the conveyance destination of a sheet P conveyed downstream from the downstream common sheet discharge route 93, between the downstream lower sheet discharge route 94 and the downstream upper sheet discharge route 95. By means of the switchers 96, 97, the sheet discharge conveyor 81 is capable of switching the sheet discharge destination between the upstream stacker 82, the downstream lower stacker 84, and the downstream upper stacker 86.

The conveyance rollers 98 are arranged along the common sheet discharge route 91, the upstream sheet discharge route 92, the downstream common sheet discharge route 93, the downstream lower sheet discharge route 94, and the downstream upper sheet discharge route 95 and convey a sheet P to be discharged in the sheet discharger 7.

The upstream stacker 82 accommodates sheets P discharged from the upstream sheet discharge route 92. The upstream stacker 82 includes a sheet discharge tray 101, an end fence 102, an offset guide 103, and a pair of side fences 104.

The sheet discharge tray 101 is a tray on which sheets P discharged to the upstream stacker 82 are stacked. The sheet discharge tray 101 is capable of lifting and lowering.

The end fence 102 restricts the position of a front edge (downstream edge) of a sheet P discharged onto the sheet discharge tray 101. The end fence 102 is movable in the right and left direction.

The offset guide 103 restricts the position of a rear edge (upstream edge) of a sheet P discharged onto the sheet discharge tray 101. The offset guide 103 is movable in the right and left direction.

The pair of side fences 104 restrict the position of a sheet P discharged onto the sheet discharge tray 101 in the width direction of the sheet P. The side fences 104 are movable in the width direction of the sheet P.

The upstream sheet discharge jam detector 83 detects whether a sheet discharge jam which is a jam of a sheet P in the upstream stacker 82 has occurred and a jam state of the sheet discharge jam.

The sheet discharge jam in the upstream stacker 82 includes: the retention of a sheet P conveyed from the upstream sheet discharge route 92 to the upstream stacker 82; the leaning of a sheet P against the end fence 102 or the offset guide 103; and a sheet discharge misalignment in which the position of a sheet P on the sheet discharge tray 101 is not aligned properly.

The jam state of the sheet discharge jam indicates whether sheet discharge is possible. The retention in the above described retention of a sheet P where the retained sheet P is discharged within a prescribed time by continuing the conveyance operation, the leaning of a sheet P, and a sheet discharge misalignment are sheet discharge jams in a state where sheet discharge is possible.

The upstream sheet discharge jam detector 83 includes a sheet discharge sensor 106, a leaning detection sensor 107, and a sheet discharge misalignment detection sensor 108.

The sheet discharge sensor 106 detects a sheet P discharged from the upstream sheet discharge route 92 to the upstream stacker 82. The sheet discharge sensor 106 is arranged in the upstream vicinity of the conveyance rollers 98 arranged at a downstream end of the upstream sheet discharge route 92. The sheet discharge sensor 106 is a sensor for detecting the retention of a sheet P described above.

The leaning detection sensor 107 detects the presence or absence of a sheet P at a prescribed leaning detection position. The leaning detection position is higher than a lower end of the end fence 102 and a lower end of the offset guide 103. The leaning detection sensor 107 includes a light emitter 107*a* and a light receiver 107*b*.

The light emitter 107*a* and the light receiver 107*b* are arranged to be spaced from each other in the right and left direction and to face each other with the end fence 102 and the offset guide 103 interposed therebetween. The light emitter 107*a* emits light toward the light receiver 107*b*. The light receiver 107*b* receives light emitted by the light emitter 107*a* when a sheet P is not present between the light emitter 107*a* and the light receiver 107*b*, and does not receive light when light emitted by the light emitter 107*a* is interrupted by a sheet P. Thus, the leaning detection sensor 107 detects the leaning of a sheet P described above when the light receiver 107*b* does not receive light emitted by the light emitter 107*a*.

The sheet discharge misalignment detection sensor 108 detects a sheet P which protrudes toward a downstream side (the right side) of the end fence 102. The sheet discharge misalignment detection sensor 108 is a sensor for detecting a sheet discharge misalignment described above.

The downstream lower stacker 84 accommodates sheets P discharged from the downstream lower sheet discharge route 94. The downstream lower stacker 84 includes a sheet discharge tray 111, an end fence 112, an offset guide 113, and a pair of side fences 114.

The sheet discharge tray 111, the end fence 112, the offset guide 113, and the pair of side fences 114 have the same configurations as the sheet discharge tray 101, the end fence 102, the offset guide 103, and the pair of side fences 104 of the upstream stacker 82 described above, respectively.

The downstream sheet discharge jam detector 85 detects whether a sheet discharge jam which is a jam of a sheet P in the downstream lower stacker 84 has occurred and a jam state of the sheet discharge jam. As with the sheet discharge jam in the upstream stacker 82, the sheet discharge jam in the downstream lower stacker 84 includes: the retention of a sheet P conveyed from the downstream lower sheet discharge route 94 to the downstream lower stacker 84; the leaning of a sheet P against the end fence 112 or the offset guide 113; and a sheet discharge misalignment on the sheet discharge tray 111.

The downstream sheet discharge jam detector 85 includes a sheet discharge sensor 116, a leaning detection sensor 117, and a sheet discharge misalignment detection sensor 118.

The sheet discharge sensor 116 detects a sheet P discharged from the downstream lower sheet discharge route 94 to the downstream lower stacker 84. The sheet discharge sensor 116 is arranged in the upstream vicinity of the conveyance rollers 98 arranged at a downstream end of the downstream lower sheet discharge route 94. The sheet discharge sensor 116 is a sensor for detecting the retention of a sheet P described above.

The leaning detection sensor 117 has the same configuration as the leaning detection sensor 107 of the upstream sheet discharge jam detector 83 described above and includes a light emitter 117*a* and a light receiver 117*b*.

The sheet discharge misalignment detection sensor 118 has the same configuration as the sheet discharge misalignment detection sensor 108 of the upstream sheet discharge jam detector 83 described above.

The downstream upper stacker 86 accommodates sheets P discharged from the downstream upper sheet discharge route 95. The downstream upper stacker 86 includes an end fence 121 and a pair of side fences 122.

The end fence 121 restricts the position of a front edge (downstream edge) of a sheet P discharged onto the downstream upper stacker 86. The end fence 121 is movable in the right and left direction.

The pair of side fences 122 restrict the position of a sheet P discharged onto the downstream upper stacker 86 in the width direction of the sheet P. The side fences 122 are movable in the width direction of the sheet P.

The controller 87 controls operations of the respective components of the sheet discharger 7. The controller 87 includes a CPU, a memory, and the like. The controller 87 is able to communicate with the controller 14 of the sheet feeding apparatus 2, the controller 33 of the upstream printer 3, the controller 44 of the reversal apparatus 4, the controller 63 of the downstream printer 5, and the controller 74 of the image inspection apparatus 6.

Next, operations of the printing system 1 will be described.

When printing is performed in the printing system 1, the sheet feeding apparatus 2 picks up a sheet P from the upper sheet feeder 11 or the lower sheet feeder 12 and feeds the sheet P to the upstream printer 3. The upstream printer 3 conveys the sheet P, while performing printing on one surface of the sheet P by means of the printing unit 32.

The reversal apparatus 4 reverses the sheet P having the one surface printed by the upstream printer 3, upside down by means of the switchback conveyor 42, and conveys the reversed sheet P to the downstream printer 5 with the other surface (not printed yet) facing upward. The downstream printer 5 conveys the sheet P, while performing printing on the other surface of the sheet P by means of the printing unit 62. As a result, images are printed on both surfaces of the sheet P.

The image inspection apparatus 6 inspects the images printed on both surfaces of the sheet P and conveys the sheet P to the sheet discharger 7. The sheet discharger 7 discharges the printed sheet P to the upstream stacker 82 or the downstream lower stacker 84.

In the case where a sheet P is discharged to the upstream stacker 82, the sheet discharge tray 101 is controlled to lower in accordance with an increase of sheets P stacked on the sheet discharge tray 101 so as to maintain the height position of a top surface of a stack of sheets P stacked on the sheet discharge tray 101 at a prescribed position. Also for the case where a sheet P is discharged to the downstream lower stacker 84, the sheet discharge tray 111 is controlled in the same way.

In the present embodiment, the upstream stacker 82 or the downstream lower stacker 84 is set as the sheet discharge destination during a printing operation. As described later, the downstream upper stacker 86 is used in the case where a sheet discharge jam has occurred.

Next, operations of the printing system 1 in the case where a sheet discharge jam has occurred during the printing operation as described above will be described.

In the case where the upstream stacker 82 is set as the sheet discharge destination during the printing operation, the controller 87 of the sheet discharger 7 determines that a sheet discharge jam has occurred when at least one of the retention of a sheet P, the leaning of a sheet P, or a sheet discharge misalignment described above is detected by the upstream sheet discharge jam detector 83.

Specifically, the controller 87 determines that the retention of a sheet P has occurred when the detection timing of the rear edge of a sheet P by the sheet discharge sensor 106 is later than a theoretical value by a prescribed threshold value or more.

The controller 87 determines that the leaning of a sheet P has occurred when the number of discharged sheets P in an ON state where the leaning detection sensor 107 is detecting a sheet P (a state where the light receiver 107*b* is receiving light emitted by the light emitter 107*a*) reaches a prescribed number.

The controller 87 determines that a sheet discharge misalignment has occurred when the sheet discharge misalignment detection sensor 108 detects a sheet P which protrudes toward a downstream side (the right side) of the end fence 102.

The controller 87 determines that a sheet discharge jam has occurred when determining that at least one of the retention of a sheet P, the leaning of a sheet P, or a sheet discharge misalignment has occurred.

Also for the case where the downstream lower stacker 84 is set as the sheet discharge destination during the printing operation, the controller 87 determines that a sheet discharge jam has occurred when at least one of the retention of a sheet P, the leaning of a sheet P, or a sheet discharge misalignment is detected by the downstream sheet discharge jam detector 85.

Figure 4:
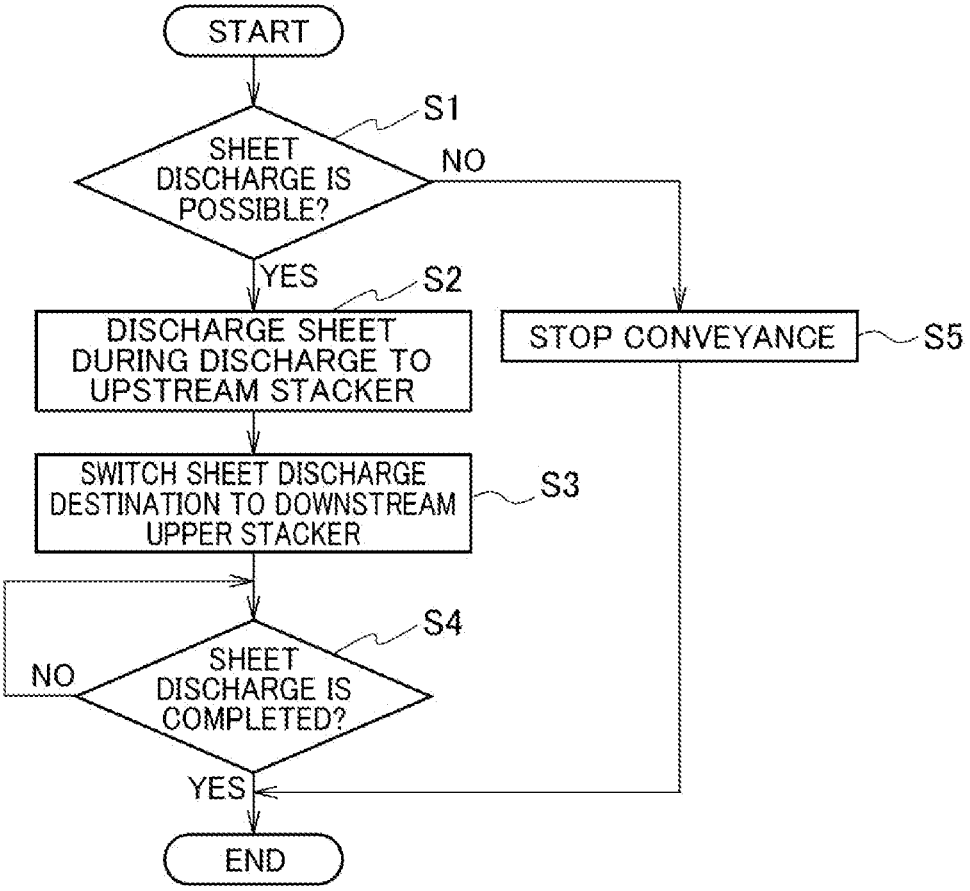
FIG. 4 is a flowchart for explaining operations of the printing system in the case where a sheet discharge jam has occurred, according to the first embodiment.

FIG. 4 is a flowchart for explaining operations of the printing system 1 in the case where a sheet discharge jam has occurred. Although operations in the case where the upstream stacker 82 is set as the sheet discharge destination during the printing operation will be described below, operations in the case where the downstream lower stacker 84 is set as the sheet discharge destination during the printing operation are the same.

When the controller 87 determines that the sheet discharge jam has occurred, in step S1 in FIG. 4, a controller 87 determines whether the sheet discharge jam that has occurred is a sheet discharge jam in the state where sheet discharge is possible.

When the sheet discharge jam that has occurred is only at least one of the leaning of a sheet P or a sheet discharge misalignment and the retention of a sheet P has not occurred, the controller 87 determines that the sheet discharge jam that has occurred is a sheet discharge jam in the state where sheet discharge is possible.

Even when the retention of a sheet P has occurred, the controller 87 determines that the sheet discharge jam that occurred is a sheet discharge jam in the state where sheet discharge is possible, if the retained sheet P is discharged and the retention is resolved within the prescribed time from determination of the occurrence of the retention of a sheet P by continuing conveyance operation of the sheet discharge conveyor 81. That the retained sheet P has been discharged is detected by the sheet discharge sensor 106 switching from ON (a state where a sheet P is being detected) to OFF (a state where a sheet P is not being detected).

When the controller 87 determines that the sheet discharge jam that has occurred is a sheet discharge jam in the state where sheet discharge is possible (step S1: YES), in step S2, the controller 87 discharges a sheet P which is being discharged to the upstream stacker 82 at the time of the occurrence of the sheet discharge jam, to the upstream stacker 82. That is, the controller 87 controls the sheet discharge conveyor 81 to continue sheet discharge. Note that the sheet P which is being discharged to the upstream stacker 82 at the time of the occurrence of the sheet discharge jam is a sheet P whose front edge has entered the upstream sheet discharge route 92 at the time of the occurrence of the sheet discharge jam.

Next, in step S3, the controller 87 controls the sheet discharge conveyor 81 to switch the sheet discharge destination of sheets P to the downstream upper stacker 86 after discharge of the sheet P which is being discharged to the upstream stacker 82 at the time of the occurrence of the sheet discharge jam. Thus, a sheet P is discharged to the downstream upper stacker 86 after the sheet P which is being discharged to the upstream stacker 82 at the time of the occurrence of the sheet discharge jam is discharged to the upstream stacker 82.

In the printing system 1, when a sheet discharge jam is detected, feeding of sheets P by the upper sheet feeder 11 and the lower sheet feeder 12 is stopped and printing by the printing unit 32 of the upstream printer 3 and the printing unit 62 of the downstream printer 5 is also stopped at that time.

Printing is stopped in response to the detection of a sheet discharge jam as described above and thus there is a possibility that a sheet(s) P discharged after the occurrence of the sheet discharge jam has not been properly printed. To handle this situation, by switching the sheet discharge destination in step S3 described above, a sheet(s) P which possibly has not been properly printed is discharged to the downstream upper stacker 86 which is different from the upstream stacker 82 originally set as the sheet discharge destination.

Next, in step S4, the controller 87 determines whether sheet discharge is completed. Sheet discharge is completed when all of the sheets P which were being conveyed in the printing system 1 at the time of the occurrence of the sheet discharge jam are discharged. When the controller 87 determines that sheet discharge is not completed (step S4: NO), the controller 87 repeats the operation of step S4.

When the controller 87 determines that sheet discharge is completed (step S4: YES), the series of operations is completed. At that time, operations of the sheet feed conveyor 13, the print conveyor 31, the reversal upstream conveyor 41, the switchback conveyor 42, the reversal downstream conveyor 43, the print conveyor 61, the inspection conveyor 71, and the sheet discharge conveyor 81 are stopped.

When the controller 87 determines that the sheet discharge jam that has occurred is not a sheet discharge jam in the state where sheet discharge is possible in step S1 (step S1: NO), in step S5, the controllers 14, 33, 44, 63, 74, and 87 stop the conveyance of sheets P by the sheet feed conveyor 13, the print conveyor 31, the reversal upstream conveyor 41, the switchback conveyor 42, the reversal downstream conveyor 43, the print conveyor 61, the inspection conveyor 71, and the sheet discharge conveyor 81, respectively. The series of operations is thereby completed.

When the conveyance of sheets P is stopped in step S5, sheets P remaining inside the respective apparatuses of the printing system 1 are removed manually by a user.

As explained above, in the sheet discharger 7, the controller 87 controls the sheet discharge conveyor 81 to continue sheet discharge when a sheet discharge jam in the state where sheet discharge is possible is detected. Thus, situations where a large number of sheets P remains in the printing system 1 due to the occurrence of a sheet discharge jam can be lessened. As a result, it is possible to reduce labor for removing sheets P remaining in the printing system 1 at the time of the occurrence of a jam.

In the sheet discharger 7, in the case where the upstream stacker 82 is set as the sheet discharge destination, the controller 87 controls the sheet discharge conveyor 81 to switch the sheet discharge destination of sheets P to the downstream upper stacker 86 after discharge of the sheet P which is being discharged to the upstream stacker 82 originally set as the sheet discharge destination at the time of the occurrence of a sheet discharge jam in the state where sheet discharge is possible. Thus, it is possible to separately discharge a sheet(s) P which is highly likely to have been properly printed and a sheet(s) P which is likely to have not been properly printed to the different sheet discharge destinations.

Next, a second embodiment in which the operations of the first embodiment for the case where a sheet discharge jam has occurred are modified will be described.

Figure 5:
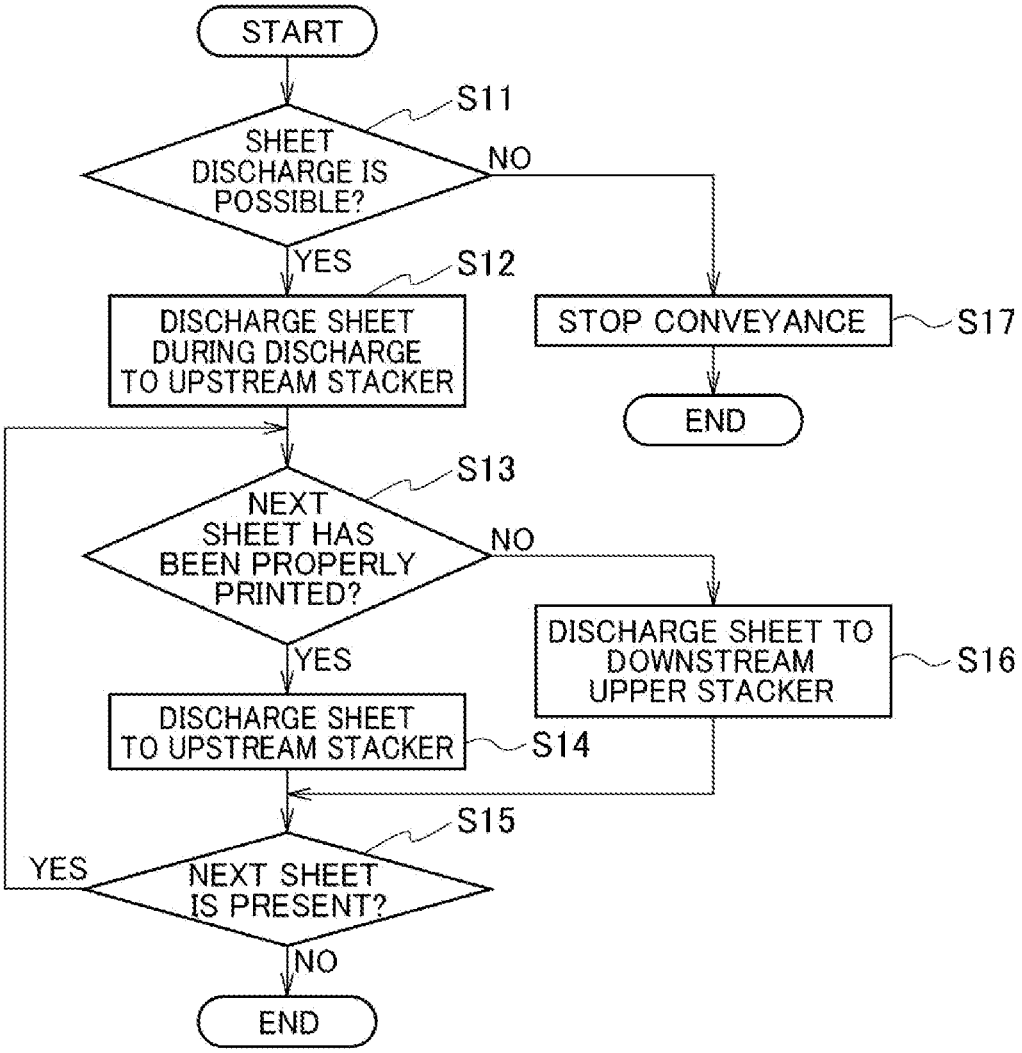
FIG. 5 is a flowchart for explaining operations of a printing system in the case where a sheet discharge jam has occurred, according to a second embodiment.

FIG. 5 is a flowchart for explaining operations of a printing system 1 in the case where a sheet discharge jam has occurred, according to the second embodiment. Although operations in the case where the upstream stacker 82 is set as the sheet discharge destination during the printing operation will be described below as with the first embodiment, operations in the case where the downstream lower stacker 84 is set as the sheet discharge destination during the printing operation are the same.

The processing in steps S11 and S12 of FIG. 5 is the same as the processing in steps S1 and S2 of FIG. 4.

Next, in step S13, the controller 87 determines whether the next sheet P (the sheet P discharged next) is a sheet P which has been properly printed.

The controller 74 of the image inspection apparatus 6 inspects whether a sheet P conveyed from the downstream printer 5 is a sheet P which has been properly printed by the upstream printer 3 and the downstream printer 5 based on read data obtained by reading the images printed on the sheet P conveyed from the downstream printer 5 with the inspection units 72, 73. The controller 74 determines that the sheet P is not a sheet P which has been properly printed when printing of an image on at least either of the surfaces of the sheet P has not been completed or when an image on the front surface of the sheet P and an image on the rear surface of the sheet P are not aligned, for example.

The controller 87 of the sheet discharger 7 obtains inspection results of sheets P from the controller 74 of the image inspection apparatus 6 and determines whether the respective sheets P are sheets P which have been properly printed based on the obtained inspection results.

When the controller 87 determines that the next sheet P is a sheet P which has been properly printed (step S13: YES), in step S14, the controller 87 controls the sheet discharge conveyor 81 to discharge the next sheet P to the upstream stacker 82.

Next, in step S15, the controller 87 determines whether a next sheet P is present. When the controller 87 determines that a next sheet P is present (step S15: YES), the controller 87 returns to step S13.

When the controller 87 determines that a next sheet P is not present (step S15: NO), the series of operations is completed. At that time, operations of the sheet feed conveyor 13, the print conveyor 31, the reversal upstream conveyor 41, the switchback conveyor 42, the reversal downstream conveyor 43, the print conveyor 61, the inspection conveyor 71, and the sheet discharge conveyor 81 are stopped.

When the controller 87 determines in step 13 that the next sheet P is not a sheet P which has been properly printed (step S13: NO), in step S16, the controller 87 controls the sheet discharge conveyor 81 to discharge the next sheet P to the downstream upper stacker 86. Thereafter, the controller 87 proceeds to step S15.

When the controller 87 determines in step S11 that the sheet discharge jam that has occurred is not a sheet discharge jam in the state where sheet discharge is possible (step S11: NO), the controller 87 proceeds to step S17. The processing of step S17 is the same as the processing of step S5 of FIG. 4 described above. The conveyance of sheets P is stopped in step S17 and then the series of operations is completed.

As explained above, also in the second embodiment as with the first embodiment, the controller 87 controls the sheet discharge conveyor 81 to continue sheet discharge when a sheet discharge jam in the state where sheet discharge is possible is detected. Thus, as with the first embodiment, it is possible to reduce labor for removing sheets P remaining in the printing system 1 at the time of the occurrence of the jam.

In the second embodiment, in the case where the upstream stacker 82 is set as the sheet discharge destination, the controller 87 controls the sheet discharge conveyor 81 to switch, between the upstream stacker 82 and the downstream upper stacker 86, the sheet discharge destination of a subsequent sheet(s) P discharged after the sheet P which is being discharged to the upstream stacker 82 originally set as the sheet discharge destination at the time of the occurrence of a sheet discharge jam in the state where sheet discharge is possible, depending on whether the subsequent sheet(s) P is a sheet P which has been properly printed by the upstream printer 3 and the downstream printer 5. Thus, it is possible to separately discharge a sheet(s) P which has been properly printed and a sheet(s) P which has not been properly printed to the different sheet discharge destinations.

Figure 6:
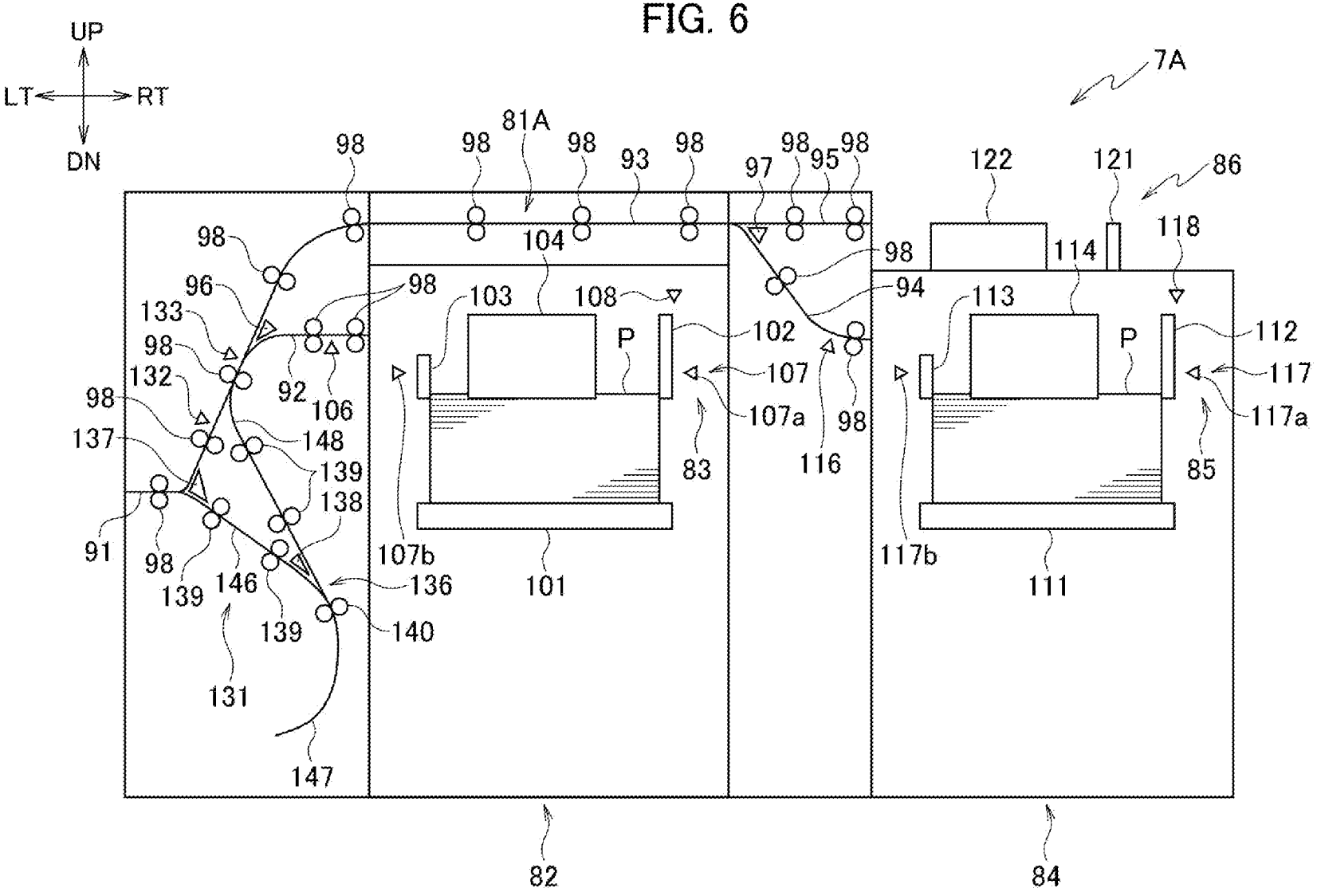
FIG. 6 is a schematic configuration diagram of a sheet discharger according to a third embodiment.

Next, a third embodiment in which parts of the sheet discharger 7 and the operations of the first embodiment for the case where a sheet discharge jam has occurred are modified will be described. FIG. 6 is a schematic configuration diagram of a sheet discharger 7A according to the third embodiment.

As illustrated in FIG. 6, the sheet discharger 7A according to the third embodiment has a configuration where the sheet discharge conveyor 81 of the sheet discharger 7 according to the first embodiment described above is replaced by a sheet discharge conveyor 81A.

The sheet discharge conveyor 81A has a configuration where a sheet discharge reversal unit 131 and sheet sensors 132, 133 are added to the sheet discharge conveyor 81 of the sheet discharger 7 as illustrated in FIG. 3.

The sheet discharge reversal unit 131 reverses a sheet P upside down, the sheet P having been conveyed from the image inspection apparatus 6 to the sheet discharge conveyor 81A. The sheet discharge reversal unit 131 includes a sheet discharge reversal route (branch route) 136, switchers 137, 138, conveyance rollers 139, and switchback rollers 140.

The sheet discharge reversal route 136 is a conveyance route for reversing a sheet P upside down by feeding the sheet P in reverse. The sheet discharge reversal route 136 is connected to a part of the common sheet discharge route (common route) 91. The sheet discharge reversal route 136 includes a sheet discharge reversal upstream route 146, a switchback route 147, and a sheet discharge reversal downstream route 148.

The sheet discharge reversal upstream route 146 is a conveyance route for conveying a sheet P from a part of the common sheet discharge route 91 to the switchback rollers 140. An upstream end of the sheet discharge reversal upstream route 146 is connected to the common sheet discharge route 91 in the downstream vicinity of the conveyance rollers 98. A downstream end of the sheet discharge reversal upstream route 146 is connected to one end (upper end) of the switchback route 147.

The switchback route 147 is a conveyance route for feeding a sheet P in reverse. One end (upper end) of the switchback route 147 is connected to the downstream end of the sheet discharge reversal upstream route 146 and an upstream end of the sheet discharge reversal downstream route 148.

The sheet discharge reversal downstream route 148 is a conveyance route for retuning a sheet P fed in reverse by the switchback rollers 140 to the common sheet discharge route 91. The upstream end of the sheet discharge reversal downstream route 148 is connected to the one end (upper end) of the switchback route 147. A downstream end of the sheet discharge reversal downstream route 148 is connected to the common sheet discharge route 91 in the upstream vicinity of the third pair of the conveyance rollers 98 from the upstream side.

The switcher 137 switches a conveyance route of a sheet P between the common sheet discharge route 91 and the sheet discharge reversal upstream route 146 in the downstream vicinity of the conveyance rollers 98. The switcher 138 guides a sheet P before being fed in reverse, from the sheet discharge reversal upstream route 146 to the switchback route 147, and guides a sheet P fed in reverse by the switchback rollers 140, from the switchback route 147 to the sheet discharge reversal downstream route 148.

The conveyance rollers 139 are arranged along the sheet discharge reversal upstream route 146 and the sheet discharge reversal downstream route 148 and conveys a sheet P before being fed in reverse and a sheet P after having been fed in reverse.

The switchback rollers 140 are rollers for feeding a sheet P in reverse. The switchback rollers 140 are rotatable forward and in reverse in order to feed a sheet P in reverse. The switchback rollers 140 are arranged at an upper end portion of the switchback route 147.

The sheet sensors 132, 133 detect a sheet P conveyed along the common sheet discharge route 91. The sheet sensor 132 is arranged in the downstream vicinity of the conveyance rollers 98 between a connection point of the common sheet discharge route 91 and the sheet discharge reversal upstream route 146 and a connection point of the common sheet discharge route 91 and the sheet discharge reversal downstream route 148. The sheet sensor 133 is arranged at a downstream end of the common sheet discharge route 91, downstream of the connection point of the common sheet discharge route 91 and the sheet discharge reversal downstream route 148.

Next, by referring to the flowchart of FIG. 7, operations of the printing system 1 in the case where the sheet discharge destination is the upstream stacker 82 and a sheet discharge jam where a sheet P is retained in the state where sheet discharge is not possible has occurred will be described.

Figure 7:
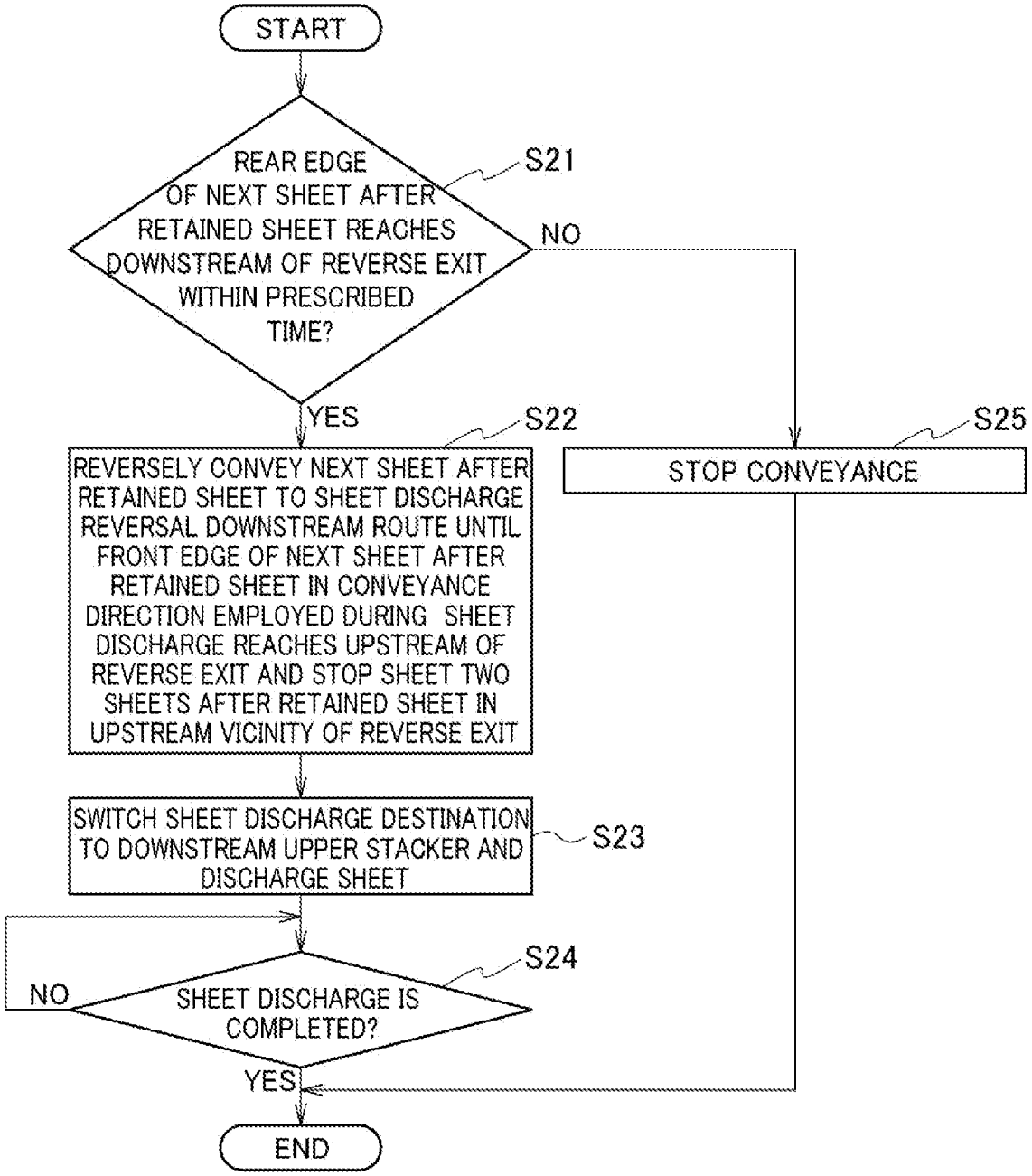
FIG. 7 is a flowchart for explaining operations of a printing system in the case where the sheet discharge destination is an upstream stacker and a sheet discharge jam where a sheet is retained in a state where sheet discharge is not possible has occurred, according to the third embodiment.

The processing of the flowchart of FIG. 7 is started by the determination that a sheet discharge jam where a sheet P is retained has occurred in the case where the sheet discharge destination is the upstream stacker 82 and the sheet discharge jam that has occurred is not the sheet discharge jam in the state where sheet discharge is possible (i.e. is a sheet discharge jam in the state where sheet discharge is not possible).

Here, it is assumed that the next sheet P after the retained sheet, which is a sheet P causing the retention sheet discharge jam, has entered the upstream sheet discharge route (first stack route) 92 at the time of the determination that the sheet discharge jam where a sheet P is retained is not a sheet discharge jam in the state where sheet discharge is possible.

Note that a sheet P to be discharged may or may not be reversed upside down in the sheet discharge conveyor 81A.

In the third embodiment, even when it is determined that a sheet discharge jam where a sheet P is retained has occurred in the case where the sheet discharge destination is the upstream stacker 82 and the sheet discharge jam that has occurred is not a sheet discharge jam in the state where sheet discharge is possible, sheet conveyance is not stopped at that time.

When a sheet discharge jam where a sheet P is retained is detected, as with the first and second embodiments, feeding of a sheet(s) P by the upper sheet feeder 11 and the lower sheet feeder 12 is stopped and printing by the printing unit 32 of the upstream printer 3 and the printing unit 62 of the downstream printer 5 is also stopped at that time.

In step S21 in FIG. 7, the controller 87 determines whether a rear edge of the next sheet P after the retained sheet has reached downstream of a reverse exit within a prescribed time after determining that the sheet discharge jam where a sheet P is retained is not a sheet discharge jam in the state where sheet discharge is possible. The reverse exit is the connection point of the common sheet discharge route 91 and the sheet discharge reversal downstream route 148.

When the controller 87 determines that the rear edge of the next sheet P after the retained sheet has reached downstream of the reverse exit within the prescribed time (step S21: YES), in step S22, the controller 87 controls the sheet discharge conveyor 81A to reversely convey the next sheet P after the retained sheet into the sheet discharge reversal downstream route 148 until a front edge (front edge of sheet P in the conveyance direction employed during sheet discharge) of the next sheet P after the retained sheet reaches upstream of the reverse exit. The controller 87 also controls the sheet discharge conveyor 81A to stop the sheet P two sheets after the retained sheet in the upstream vicinity of the reverse exit in the common sheet discharge route 91.

Figure 8:
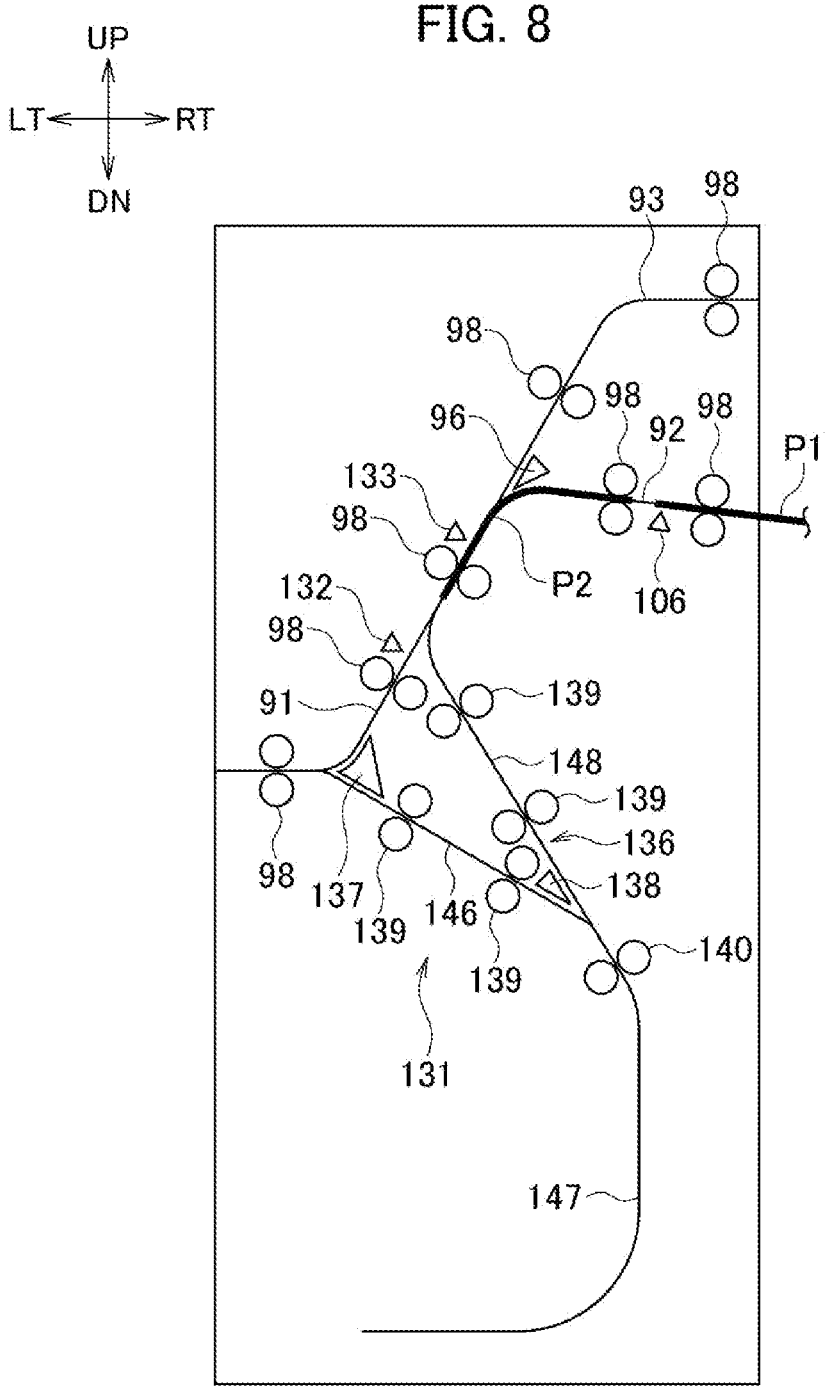
FIG. 8 is an explanatory view explaining operations of a sheet discharge conveyor in the case where the sheet discharge destination is an upstream stacker and a sheet discharge jam where a sheet is retained in a state where sheet discharge is not possible has occurred, according to the third embodiment.

Specifically, as illustrated in FIG. 8, the controller 87 stops a sheet P2, which is the sheet P after the sheet P1 that is the retained sheet, with a rear edge of the sheet P2 having reached downstream of the reverse exit. Note that the sheet P1 which is the retained sheet is a sheet P retained at an exit (downstream end) of the upstream sheet discharge route 92.

The controllers 14, 33, 44, and 63 stop the conveyance of sheets P by the sheet feed conveyor 13, the print conveyor 31, the reversal upstream conveyor 41, the switchback conveyor 42, the reversal downstream conveyor 43, and the print conveyor 61, respectively. The conveyance of sheets P by the inspection conveyor 71 is continued.

Figure 9:
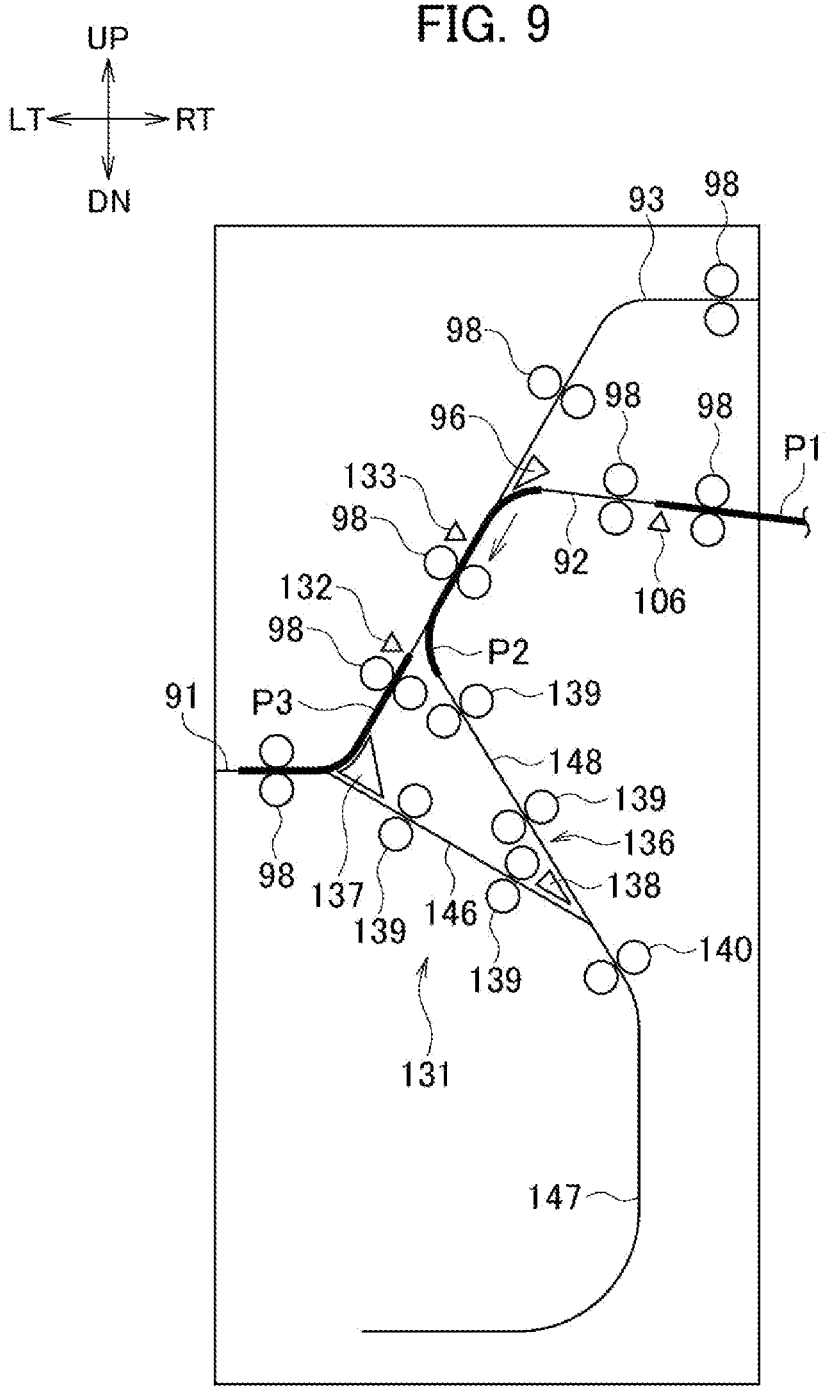
FIG. 9 is an explanatory view explaining operations of a sheet discharge conveyor in the case where the sheet discharge destination is an upstream stacker and a sheet discharge jam where a sheet is retained in a state where sheet discharge is not possible has occurred, according to the third embodiment.

Next, as illustrated in FIG. 9, the controller 87 controls the sheet discharge conveyor 81A to convey the sheet P2 from the downstream side in the conveyance direction employed during sheet discharge into the sheet discharge reversal downstream route 148. Note that the connection point of the common sheet discharge route 91 and the sheet discharge reversal downstream route 148 (the reverse exit) has a structure where a sheet P conveyed from the downstream side in the conveyance direction employed during sheet discharge, in the direction opposite to the conveyance direction employed during sheet discharge along the common sheet discharge route 91 enters the sheet discharge reversal downstream route 148.

Figure 10:
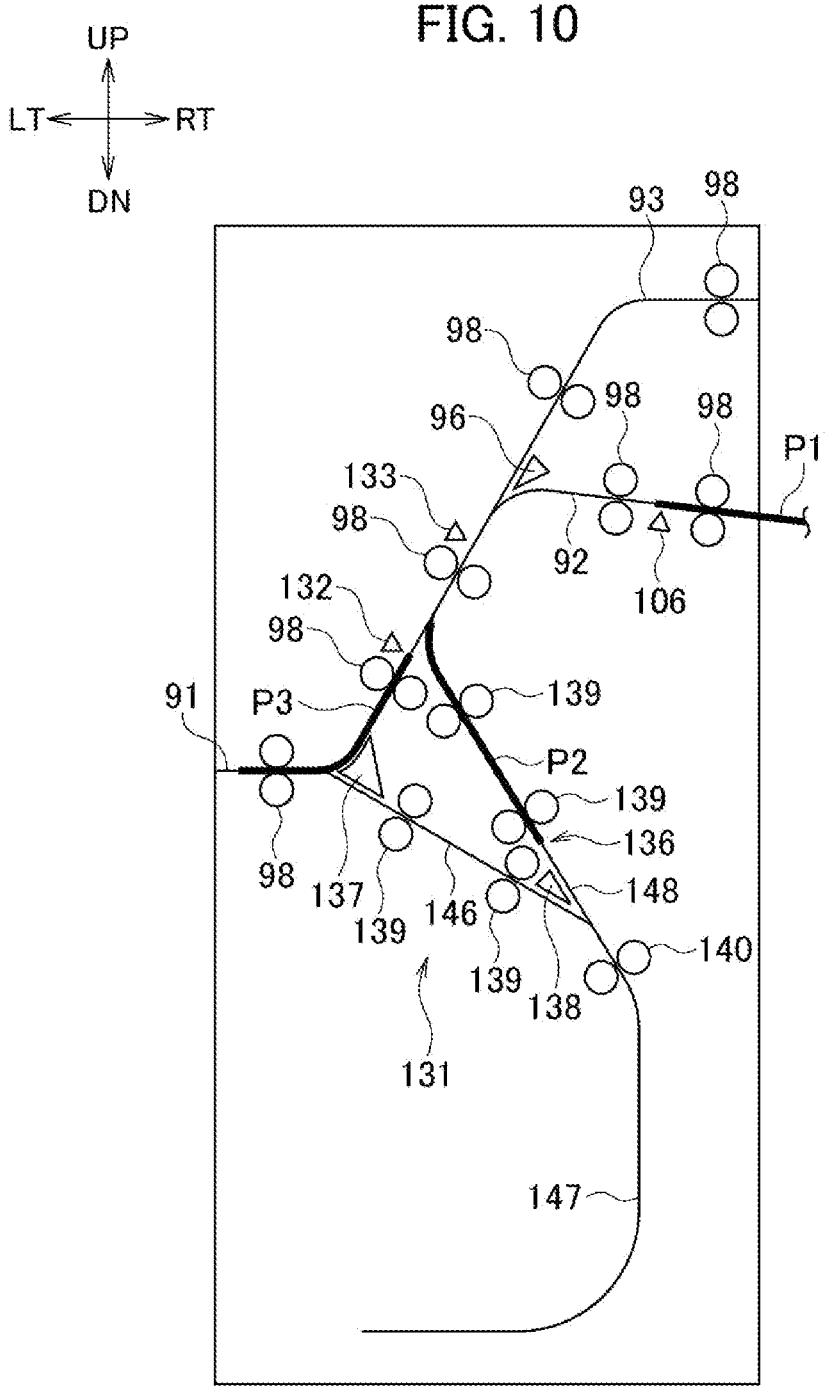
FIG. 10 is an explanatory view explaining operations of a sheet discharge conveyor in the case where the sheet discharge destination is an upstream stacker and a sheet discharge jam where a sheet is retained in a state where sheet discharge is not possible has occurred, according to the third embodiment.

Then, as illustrated in FIG. 10, the controller 87 controls the sheet discharge conveyor 81A to stop the sheet P2 when a front edge of the sheet P2 (rear edge of the sheet P2 in the reverse sheet conveyance) reaches upstream of the reverse exit. Note that the controller 87 is able to determine whether the front edge of the sheet P2 has reached upstream of the reverse exit based on the elapsed time from the detection of the front edge of the sheet P2 by the sheet sensor 133.

At the same time, as illustrated in FIGS. 9 and 10, the controller 87 controls the sheet discharge conveyor 81A to stop a sheet P3 conveyed from the inspection conveyor 71 in the upstream vicinity of the reverse exit in the common sheet discharge route 91. The sheet P3 is the sheet P two sheets after the retained sheet (the sheet P after the sheet P2). The controller 74 also stops the operation of the inspection conveyor 71. Note that the controller 87 is able to determine whether the sheet P3 has reached the upstream vicinity of the reverse exit in the common sheet discharge route 91 based on the detection of a front edge of the sheet P3 by the sheet sensor 132.

In step S23 of FIG. 7, the controller 87 controls the sheet discharge conveyor 81A to switch the sheet discharge destination to the downstream upper stacker 86 and perform sheet discharge.

Specifically, the controller 87 controls the switcher 96 to switch the conveyance destination of a sheet P conveyed downstream from the common sheet discharge route 91 to the downstream common sheet discharge route 93. The controller 87 also controls the switcher 97 to switch the conveyance destination of a sheet P conveyed downstream from the downstream common sheet discharge route 93 to the downstream upper sheet discharge route 95.

Figure 11:
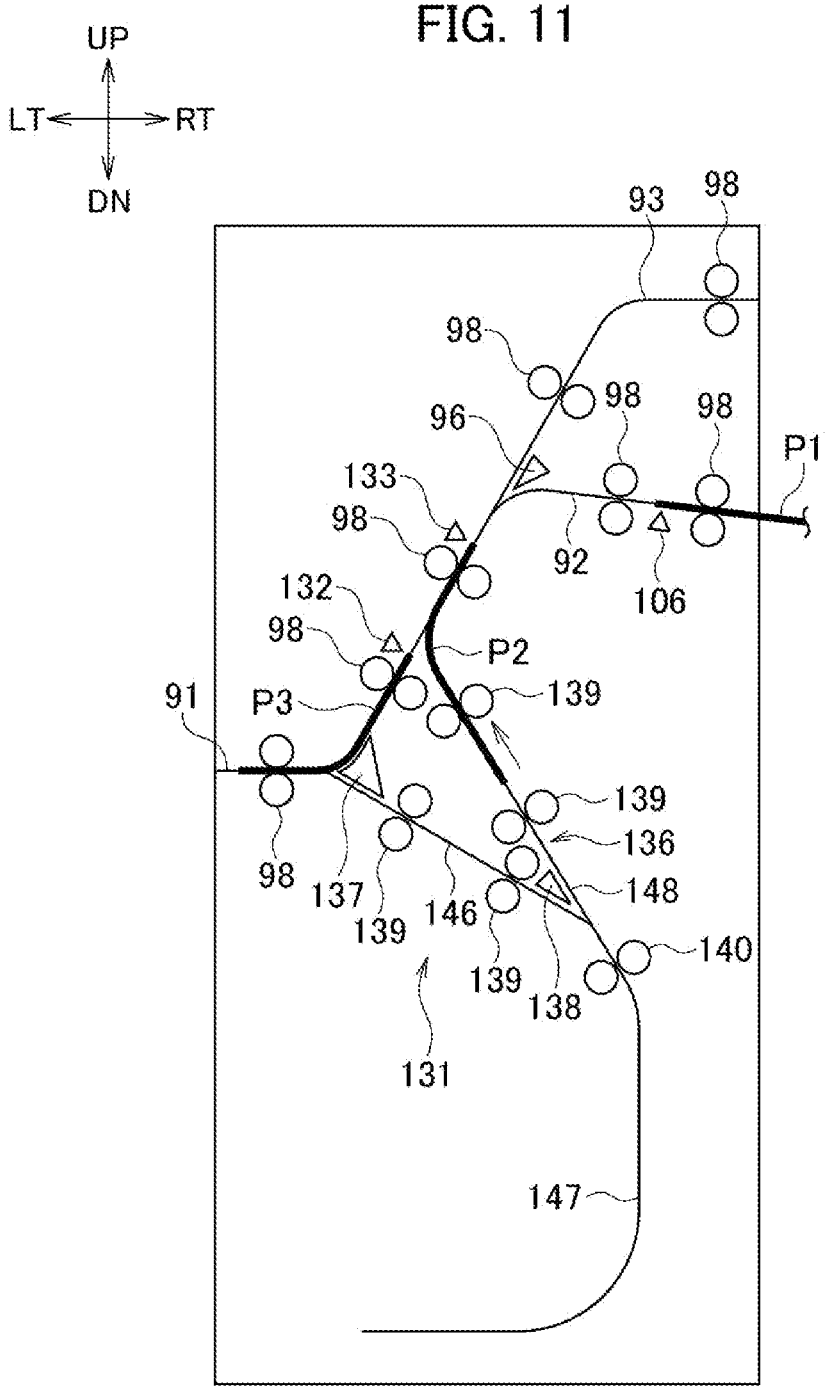
FIG. 11 is an explanatory view explaining operations of a sheet discharge conveyor in the case where the sheet discharge destination is an upstream stacker and a sheet discharge jam where a sheet is retained in a state where sheet discharge is not possible has occurred, according to the third embodiment.
Figure 12:
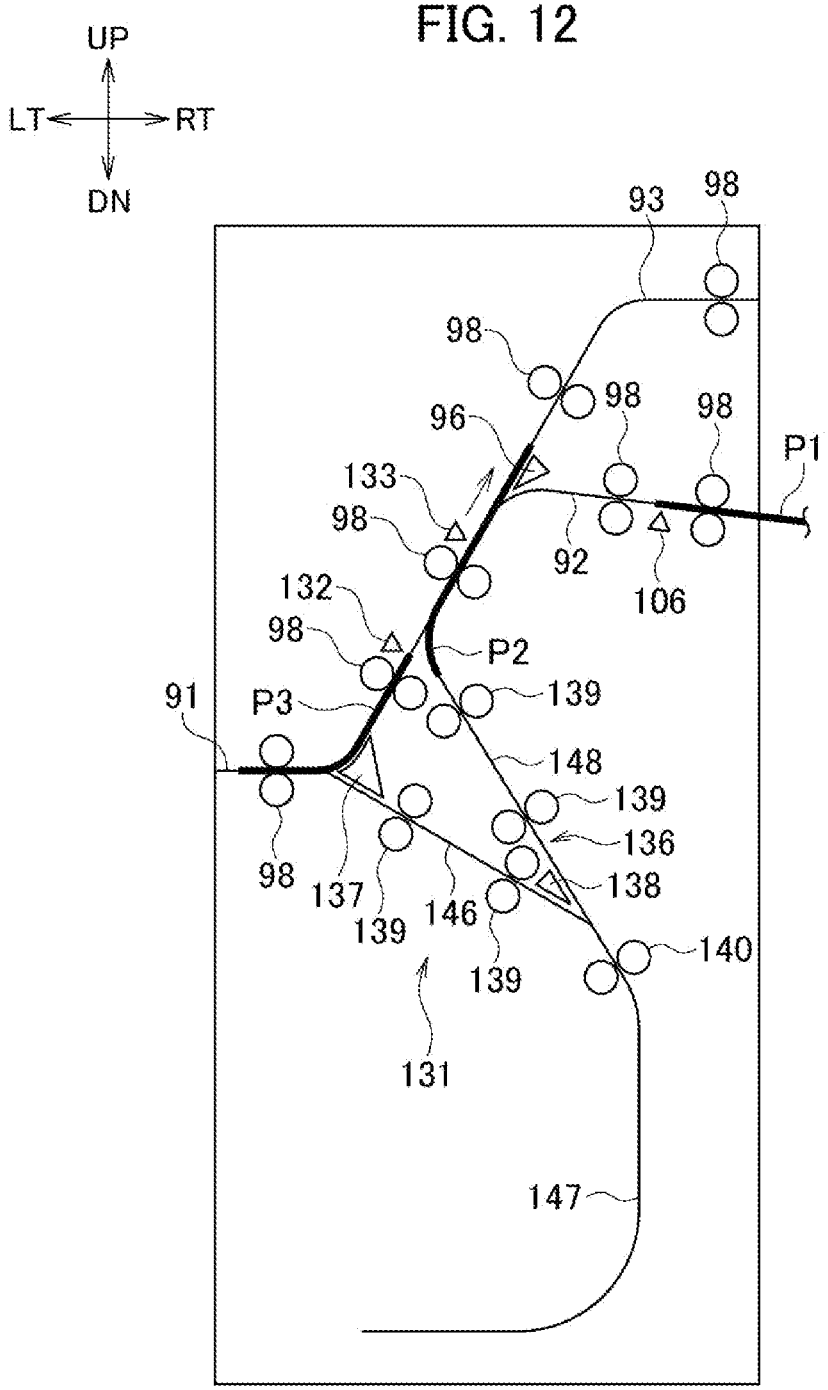
FIG. 12 is an explanatory view explaining operations of a sheet discharge conveyor in the case where the sheet discharge destination is an upstream stacker and a sheet discharge jam where a sheet is retained in a state where sheet discharge is not possible has occurred, according to the third embodiment.

Then, as illustrated in FIG. 11, the controller 87 controls the sheet discharge conveyor 81A to convey the sheet P2 out of the sheet discharge reversal downstream route 148. As illustrated in FIG. 12, the sheet P2 conveyed out of the sheet discharge reversal downstream route 148 is guided from the common sheet discharge route 91 to the downstream common sheet discharge route 93.

Figure 13:
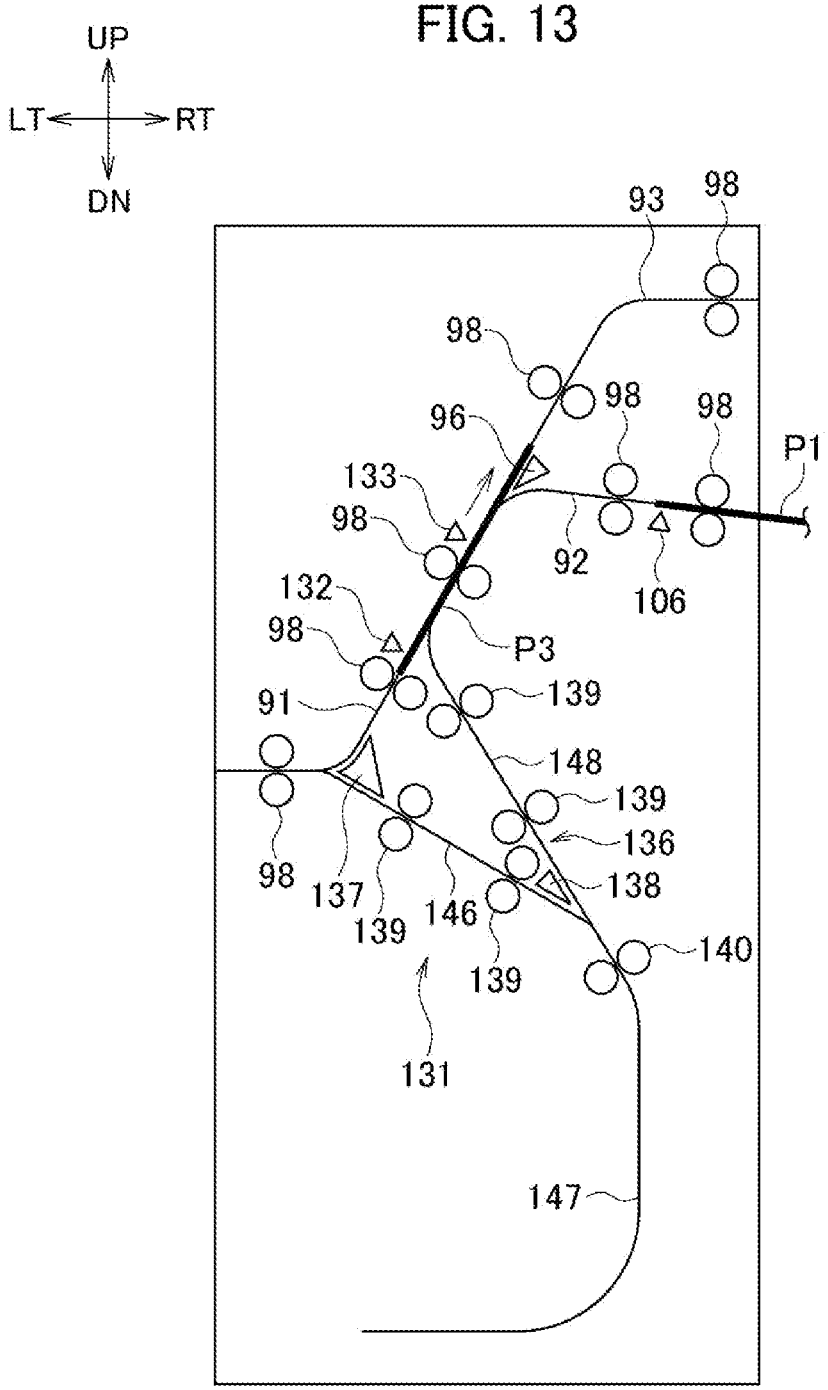
FIG. 13 is an explanatory view explaining operations of a sheet discharge conveyor in the case where the sheet discharge destination is an upstream stacker and a sheet discharge jam where a sheet is retained in a state where sheet discharge is not possible has occurred, according to the third embodiment.

As illustrated in FIG. 13, the controller 87 resumes conveyance of the sheet P3 after the rear edge of the sheet P2 exits the reverse exit. The sheet P3 is also guided from the common sheet discharge route 91 to the downstream common sheet discharge route 93.

After conveyance of the sheet P3 is resumed, the controllers 14, 33, 44, 63, and 74 resume the conveyance of sheets P by the sheet feed conveyor 13, the print conveyor 31, the reversal upstream conveyor 41, the switchback conveyor 42, the reversal downstream conveyor 43, the print conveyor 61, and the inspection conveyor 71, respectively.

Thus, the sheet P2, the sheet P3, and the sheet(s) P subsequent to the sheet P3 are discharged to the downstream upper stacker 86 via the downstream common sheet discharge route 93 and the downstream upper sheet discharge route 95. Note that a conveyance route formed of the downstream common sheet discharge route 93 and the downstream upper sheet discharge route 95 corresponds to a second stack route.

In step S24 of FIG. 7, the controller 87 determines whether the sheet discharge is completed. The sheet discharge is completed when all of the sheets P which were being conveyed in the printing system 1 at the time of the detection of the sheet discharge jam where a sheet P is retained have been discharged. When the controller 87 determines that the sheet discharge is not completed (step S24: NO), the controller 87 repeats step S24.

When the controller 87 determines that the sheet discharge is completed (step S24: YES), the series of operations is completed. At that time, operations of the sheet feed conveyor 13, the print conveyor 31, the reversal upstream conveyor 41, the switchback conveyor 42, the reversal downstream conveyor 43, the print conveyor 61, the inspection conveyor 71, and the sheet discharge conveyor 81A are stopped.

When the controller 87 determines in step S21 that the rear edge of the next sheet P after the retained sheet has not reached downstream of the reverse exit within the prescribed time (step S21: NO), in step S25, the controllers 14, 33, 44, 63, 74, and 87 stop the conveyance of sheets P by the sheet feed conveyor 13, the print conveyor 31, the reversal upstream conveyor 41, the switchback conveyor 42, the reversal downstream conveyor 43, the print conveyor 61, the inspection conveyor 71, and the sheet discharge conveyor 81A, respectively. The series of operations is thereby completed.

In the case where the next sheet P after the retained sheet is prevented from moving due to a reason such as the next sheet P after the retained sheet hitting against the retained sheet, the rear edge of the next sheet P after the retained sheet may not reach downstream of the reverse exit within the prescribed time. For this case, the process of stopping the conveyance (emergency stop) is performed in step S25 as described above.

When the conveyance of sheets P is stopped in step S25, sheets P remaining inside the respective apparatuses of the printing system 1 are removed manually by a user.

In the case where the next sheet P after the retained sheet has not entered the upstream sheet discharge route 92 at the time of the determination that the sheet discharge jam where a sheet P is retained is not a sheet discharge jam in the state where sheet discharge is possible, the controller 87 controls the sheet discharge conveyor 81A to switch the sheet discharge destination to the downstream upper stacker 86 for the next sheet P after the retained sheet and the subsequent sheets P and discharge the sheets P.

As explained above, in the third embodiment, in the case where a sheet discharge jam in the state where sheet discharge of the retained sheet retained at the exit of the upstream sheet discharge route 92 is not possible is detected, and where the next sheet P after the retained sheet has entered the upstream sheet discharge route 92 at the time of the detection of the state of the sheet discharge, the controller 87 controls the sheet discharge conveyor 81A to convey the next sheet P after the retained sheet from the downstream side in the conveyance direction employed during sheet discharge into the sheet discharge reversal route 136, then convey the next sheet P after the retained sheet out of the sheet discharge reversal route 136 and convey (discharge) the next sheet P after the retained sheet to the downstream upper stacker 86 by way of the downstream common sheet discharge route 93 and the downstream upper sheet discharge route 95, and also convey (discharge) the sheet(s) P subsequent to the next sheet P after the retained sheet to the downstream upper stacker 86.

Thus, situations where a large number of sheets P remains in the printing system 1 can be lessened even when the sheet discharge jam where a sheet P is retained in the state where sheet discharge is not possible has occurred. As a result, it is possible to reduce labor for removing sheets P remaining in the printing system 1 at the time of the occurrence of the jam.

In the third embodiment, the operations of the printing system 1 when a sheet discharge jam in the state where sheet discharge is possible is detected are the same as those of the first embodiment. The operations of the printing system 1 when a sheet discharge jam in the state where sheet discharge is possible is detected in the third embodiment may be the same as those of the second embodiment.

In the third embodiment, the sheet(s) P subsequent to the next sheet P after the retained sheet is conveyed (discharged) to the downstream upper stacker 86. However, the sheet(s) P subsequent to the next sheet P after the retained sheet may be conveyed (discharged) to the downstream lower stacker 84 by way of the downstream common sheet discharge route 93 and the downstream lower sheet discharge route 94.

In the third embodiment, the sheet discharge reversal route 136 is connected to the common sheet discharge route 91 and the reversely conveyed next sheet P after the retained sheet is conveyed into the sheet discharge reversal route 136. However, a conveyance route connected to the common sheet discharge route 91 into which the reversely conveyed next sheet P after the retained sheet is conveyed may not involve the reversal of a sheet P.

In the first embodiment, the sheet discharge destination of sheets P is switched after discharge of the sheet P which is being discharged at the time of the occurrence of a sheet discharge jam in the state where sheet discharge is possible. In the second embodiment, for the subsequent sheet(s) P discharged after the sheet P which is being discharged at the time of the occurrence of a sheet discharge jam in the state where sheet discharge is possible, the sheet discharge destination is switched depending on whether the subsequent sheet(s) P is a sheet P which has been properly printed. However, the present invention is not limited thereto and the present invention stands as long as sheet discharge is continued after the occurrence of a sheet discharge jam in the case where a sheet discharge jam as detected is a sheet discharge jam in the state where sheet discharge is possible.

In the first embodiment, the sheet discharge destination is switched from the upstream stacker 82 to the downstream upper stacker 86. However, the present invention is not limited to this and the sheet discharge destination as switched may be the downstream lower stacker 84, for example. The present invention stands as long as the sheet discharge destination of sheets P after discharge of the sheet P which is being discharged at the time of the occurrence of a sheet discharge jam in the state where sheet discharge is possible is switched to a stacker different from the previous stacker.

In the second embodiment, the sheet discharge destination is switched between the upstream stacker 82 and the downstream upper stacker 86 when the sheet discharge destination is switched depending on whether the subsequent sheet(s) P is a sheet P which has been properly printed. However, the present invention is not limited to this and the sheet discharge destination may be switched between the upstream stacker 82 and the downstream lower stacker 84, for example. The present invention stands as long as a stacker as the sheet discharge destination is switched depending on whether the subsequent sheet(s) P is a sheet P which has been properly printed.

Embodiments of the disclosure include, for example, the following configurations.

A sheet discharger includes: an accommodator configured to accommodate sheets; a conveyor configured to convey and discharge a sheet to the accommodator; a detector configured to detect whether a jam of a sheet has occurred in the accommodator and a state of the jam; and a controller configured to control the conveyor to continue sheet discharge upon detection by the detector of the jam in a state where sheet discharge of a jammed sheet is possible.

The accommodator may include a first stacker configured to accommodate sheets and a second stacker different from the first stacker and configured to accommodate sheets. The conveyor may be capable of switching a sheet discharge destination between the first stacker and the second stacker. The controller may be configured to control the conveyor to switch the sheet discharge destination to the second stacker after discharge of a sheet being discharged to the first stacker as the sheet discharge destination at a time of occurrence of the jam in the state where sheet discharge of the jammed sheet is possible.

The accommodator may include stackers configured to accommodate sheets. The conveyor may be configured to convey a sheet conveyed via a printer and be capable of switching a sheet discharge destination between the stackers. The controller may be configured to control the conveyor to switch a stacker as the sheet discharge destination for a subsequent sheet discharged after a sheet being discharged to the stacker as the sheet discharge destination at a time of occurrence of the jam in the state where sheet discharge of the jammed sheet is possible, depending on whether the subsequent sheet has been properly printed by the printer.

The accommodator may include a first stacker configured to accommodate sheets and a second stacker different from the first stacker and configured to accommodate sheets. The conveyor may include a common route, a branch route connected to a part of the common route, a first stack route extending from a downstream end of the common route in a sheet conveyance direction to the first stacker, and a second stack route extending from the downstream end of the common route to the second stacker. The jam of a sheet in the accommodator may include a jam in which a sheet being discharged to the first stacker is retained at an exit of the first stack route. Upon detection by the detector of the jam in a state where sheet discharge of a retained sheet which is a sheet retained at the exit of the first stack route is not possible and upon a next sheet after the retained sheet having entered the first stack route at a time of detection of the jam in the state, the controller may be configured to control the conveyor to convey the next sheet from a downstream side in the sheet conveyance direction into the branch route, then convey the next sheet out of the branch route to the second stacker via the second stack route, and convey a sheet subsequent to the next sheet to the second stacker.

Embodiments of the present invention have been described above. However, the invention may be embodied in other specific forms without departing from the spirit or essential characteristics thereof. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiments of the present invention.

What is claimed is:

1. A sheet discharger comprising:

a stacker configured to accommodate sheets;

a sheet discharge conveyor configured to convey and discharge a sheet to the stacker;

a detector configured to detect whether a jam of a sheet has occurred in the stacker and a state of the jam, wherein the detector includes a sheet retention discharge sensor configured to determine the time at which a rear end of a sheet is discharged from a sheet discharge route to the stacker; and a processor configured to control the sheet discharge conveyor to continue sheet discharge upon detection by the detector of the jam in a state where sheet discharge of a jammed sheet is possible, wherein the processor determines that a jam has occurred, and controls the sheet discharge conveyor to continue sheet discharge upon detection by the sheet retention discharge sensor of the jam in which sheet discharge of the jammed sheet is possible, in response to determining that the time at which the sheet retention discharge sensor detects discharge of the rear end of the sheet from the sheet discharge route is later than a predetermined time.

2. The sheet discharger according to claim 1, wherein the stacker includes a first stacker configured to accommodate sheets and a second stacker different from the first stacker and configured to accommodate sheets, the sheet discharge conveyor is capable of switching a sheet discharge destination between the first stacker and the second stacker, and the processor is configured to control the sheet discharge conveyor to switch the sheet discharge destination to the second stacker after discharge of a sheet being discharged to the first stacker as the sheet discharge destination at a time of occurrence of the jam in the state where sheet discharge of the jammed sheet is possible.

3. A sheet discharger comprising:

a stacker configured to accommodate sheets;

a sheet discharge conveyor configured to convey and discharge a sheet to the stacker:

a detector configured to detect whether a jam of a sheet has occurred in the stacker and a state of the jam; and a processor configured to control the sheet discharge conveyor to continue sheet discharge upon detection by the detector of the jam in a state where sheet discharge of a jammed sheet is possible, wherein the stacker includes stackers configured to accommodate sheets, the sheet discharge conveyor is configured to convey a sheet conveyed via a printer and is capable of switching a sheet discharge destination between the stackers, and the processor is configured to control the sheet discharge conveyor to switch a stacker as the sheet discharge destination for a subsequent sheet discharged after a sheet being discharged to the stacker as the sheet discharge destination at a time of occurrence of the jam in the state where sheet discharge of the jammed sheet is possible, depending on whether the subsequent sheet has been properly printed by the printer.

4. A The sheet discharger comprising:

a stacker configured to accommodate sheets;

a sheet discharge conveyor configured to convey and discharge a sheet to the stacker;

a detector configured to detect whether a jam of a sheet has occurred in the stacker and a state of the jam; and a processor configured to control the sheet discharge conveyor to continue sheet discharge upon detection by the detector of the jam in a state where sheet discharge of a jammed sheet is possible, wherein the stacker includes a first stacker configured to accommodate sheets and a second stacker different from the first stacker and configured to accommodate sheets, the sheet discharge conveyor includes a common route, a branch route connected to a part of the common route, a first stack route extending from a downstream end of the common route in a sheet conveyance direction to the first stacker, and a second stack route extending from the downstream end of the common route to the second stacker, the jam of a sheet in the stacker includes a jam in which a sheet being discharged to the first stacker is retained at an exit of the first stack route, and upon detection by the detector of the jam in a state where sheet discharge of a retained sheet which is a sheet retained at the exit of the first stack route is not possible and upon a next sheet after the retained sheet having entered the first stack route at a time of detection of the jam in the state, the processor is configured to control the sheet discharge conveyor to convey the next sheet from a downstream side in the sheet conveyance direction into the branch route, then convey the next sheet out of the branch route to the second stacker via the second stack route, and convey a sheet subsequent to the next sheet to the second stacker.

5. The sheet discharger according to claim 1, wherein the detector includes a sheet discharge sensor, a leaning detection sensor, and a sheet discharge misalignment detection sensor, wherein the processor is configured to control the sheet discharge conveyor to continue sheet discharge in response to detection by one of the sheet discharge sensor, the leaning detection sensor, and the sheet discharge misalignment detection sensor detecting the jam in a state where sheet discharge of the jammed sheet is possible.

6. The sheet discharger according to claim 1, further comprising a plurality of the stackers, each configured to accommodate the sheets wherein the sheet discharge conveyor is configured to convey and discharge a sheet to one of first and second stackers of the plurality of stackers, the detector is configured to detect whether a jam of a sheet has occurred in the first stacker, the processor is configured to control the sheet discharge conveyor to continue sheet discharge upon detection by the detector of the jam in a state where sheet discharge of the jammed sheet is possible, and wherein the processor is configured to control the sheet discharge conveyor to switch the stacker of the plurality of stackers to which a subsequent sheet, discharged after discharge of the jammed sheet, is discharged, in response to whether the subsequent sheet has been properly printed by a printer.

* * * * *